US005771725A

United States Patent [19]

Mizukawa

[11] Patent Number: 5,771,725

[45] Date of Patent: Jun. 30, 1998

[54] METHOD OF PRODUCING A BAND BLADE, A METHOD OF BENDING A STRIP MATERIAL, AND AN APPARATUS FOR BENDING A STIP MATERIAL

[76] Inventor: Suehiro Mizukawa, 4-25, Torikainishi 5-chome, Settsu-shi, Osaka 566, Japan

[21] Appl. No.: 687,438

[22] PCT Filed: Dec. 27, 1995

[86] PCT No.: PCT/JP95/02747

§ 371 Date: Aug. 13, 1996

§ 102(e) Date: Aug. 13, 1996

[87] PCT Pub. No.: WO96/21543

PCT Pub. Date: Jul. 18, 1996

[30] Foreign Application Priority Data

Jan. 11, 1995 [JP] Japan ..... 7/002897

[51] Int. Cl.[6] ..... B21D 5/01

[52] U.S. Cl. ..... 72/17.3; 72/294; 72/307

[58] Field of Search ..... 72/294, 307, 316, 72/14.8, 17.3

[56] References Cited

U.S. PATENT DOCUMENTS

| | | | |
|---|---|---|---|
| 3,563,283 | 2/1971 | Tufektshiev | 72/307 |
| 3,823,749 | 7/1974 | Ritter | 72/307 |
| 4,161,110 | 7/1979 | Ritter | 72/307 |
| 4,280,350 | 7/1981 | King | 72/307 |
| 4,773,284 | 9/1988 | Archer | 72/307 |
| 5,461,893 | 10/1995 | Tyler | 72/294 |

FOREIGN PATENT DOCUMENTS

| | | |
|---|---|---|
| 58-160024 | 9/1983 | Japan . |
| 7-80727 | 3/1995 | Japan . |

*Primary Examiner*—Daniel C. Crane
*Attorney, Agent, or Firm*—Jones, Tullar & Cooper, P.C.

[57] ABSTRACT

It is desirable to accurately subject a process object region of a long edged strip material to notching and bending processes. A bending apparatus and a notching apparatus are used. The process object region of the long edged strip material which is passed through an outlet of a die member of the bending apparatus is subjected to a notching process conducted by the notching apparatus. Next, the process object region is subjected to a bending process performed by the bending apparatus. Finally, the process object region is cut off from a not-yet-processed region. An encoder measures a pulled-out amount of the edged strip material obtained when the edged strip material is pressed by a presser against a shaping face of the outlet of the stationary die so as to be bent. A servomotor is operated by a rotation number in which the measured value of the encoder is considered, so that the edged strip material is fed by a predetermined length.

12 Claims, 24 Drawing Sheets

METHOD OF PRODUCING A BAND BLADE, A METHOD OF BENDING A STRIP MATERIAL, AND AN APPARATUS FOR BENDING A STIP MATERIAL

This application is a 371 of PCT/JP95/02747.

BACKGROUND OF THE INVENTION

1. Technical Field

The present invention relates to a method of producing a band blade in which notches are formed at appropriate positions in an edged strip material bent into a predetermined shape, and more particularly to a method of producing a band blade used in a Thomson blade wooden model which is used for punching a plate member or a sheet member made of wood, paper, cloth, leather, plastic, or the like into a predetermined shape, or forming cuts of a predetermined shape in such a member.

The present invention relates also to a method of bending a strip material made of a steel plate such as a blade member of the band blade, and to an apparatus for bending a strip material.

2. Prior Art

As exemplarily shown in FIG. 22, a Thomson blade wooden model is produced by pressing a band blade 1 which is bent so as to have a predetermined shape, into slitlike cuts 3 formed in a base plate 2 so as to be embedded into the plate. The band blade 1 has notches 6 which are formed at predetermined positions in the longitudinal direction by depressing the back edge. The notches 6 correspond to connecting portions 3*a* between the cuts 3 of the base plate 2, respectively. In a complete product of a Thomson blade wooden model, the edge 4 of the band blade 1 is projected from the base plate 2. The Thomson blade wooden model of FIG. 22 may be used for forming cuts of a predetermined shape in a plate member, a sheet, or the like.

Conventionally, when the band blade 1 is to be produced, a straight edged strip material which is drawn out from a coil of a hoop material consisting of an edged strip material is cut off to a required length, the notches 6 are formed in the obtained edged strip material of the constant length, the edged strip material in which the notches 6 are formed is subjected to a bending process so as to have a predetermined shape, and an extra portion at an end of the edged strip material is cut off, thereby conducting an end process.

In contrast, when the band blade 1 is to be produced from an edged strip material of a constant length, it is usual that the following steps are individually performed by using independent apparatuses: producing a number of edged strip materials of a constant length which are cut off from the above-mentioned roll; selecting an edged strip material of a constant length from a number of straight edged strip materials which are collectively stored, and forming the notches 6 in the strip material; and selecting a predetermined one from a number of edged strip materials which are collectively stored and in which the notches 6 are formed, and subjecting the selected strip material to a bending process.

In band blades 1 of plural kinds which are to be used in different Thomson blade wooden models, it is often the case that the band blades are slightly different from each other in length, or in position of forming the notch 6 or shape of the bend. When an edged strip material which has been once stored is taken out and the notches 6 are formed in the strip material or when a bending process is performed on an edged strip material which has been once stored and on which the notches 6 are formed, therefore, it is sometimes difficult to, at a glance, distinguish the edged strip material to be taken out as a process object, from other strip materials. In some cases, an edged strip material which is not a process object is erroneously determined as a process object and the notching process or the bending process is applied to the erroneously selected strip material.

When the step of cutting of a straight edged strip material from a roll, the notching step, and the bending step are independently performed as in the case of the prior art, improvement in production efficiency is restricted. Furthermore, in the case where a procedure in which a straight edged strip material of a constant length is drawn out and cut off from a coil of a hoop material and the notching process and the bending process are then applied to the single body of the edged strip material of a constant length is employed as in the prior art, a portion which is to be clamped or held by hand in the processes must be ensured in the end areas of the edged strip material. Consequently, an end process in which such portions in the end areas of the edged strip material are cut off as extra parts is necessary. In the prior art, therefore, the cutoff portions are handled as scrap, thereby wasting the material. Moreover, there arises a problem in that it is cumbersome to conduct an end process.

A known apparatus for bending an edged strip material comprises: a stationary die having a slit through which an edged strip material is to be passed; and a presser which is reciprocally movable along a path crossing the vicinity of the outlet of the slit and which presses the edged strip material passed through the slit, against a shaping face of the outlet, thereby bending the strip material.

When the bending apparatus is used and a bending process in which an edged strip material projected through the slit of the stationary die is pressed against the shaping face so as to be bent is performed, the edged strip material is pulled out by a very large force from the outlet of the stationary die as the edged strip material is bent by pressing it against the shaping face. In a bending apparatus wherein plural predetermined portions of one edged strip material are sequentially automatically subjected to a bending process under a program control of a computer, therefore, it is required to employ an amount to which the pulled-out amount by which the blade member is pulled out in the preceding bending process is considered, as the feeding amount by which the edged strip material is fed after a preceding bending process so that the portion to be subjected to the next bending process is moved to a position corresponding to the shaping face.

However, the distance by which the edged strip material is pulled out in the bending process is long when the bending angle is large, and short when the bending angle is small. Namely, the pulled-out amount is not always constant. Consequently, plural bent portions cannot be accurately determined. Even when such portions are determined, the preparation of a computer program for such a bending process is inevitably difficult and cumbersome.

In the case where an automatic apparatus is configured by combining the above-mentioned bending apparatus with a notching apparatus, a similar situation may arise when the positional accuracy of notches with respect to an edged strip material is to be enhanced.

SUMMARY OF THE INVENTION

It is an object of the present invention to provide a method of producing a band blade wherein a procedure is used in which a long straight edged strip material in which a not-yet-processed region where a process is not performed is contiguous with a process object region, notching and bending processes are performed only on the process object region, and finally the not-yet-processed region is cut off, and a step of forming notches in the edged strip material and that of bending the edged strip material into a predetermined shape can be performed as successive steps.

It is another object of the present invention to facilitate the provision of an automatic apparatus of producing a band blade in which a notching apparatus and a bending apparatus are integrated with each other.

It is a further object of the present invention to employ a procedure in which notching and bending processes are performed on an edged strip material drawn out from a coil of a hoop material, and finally only a processed region is cut off from a portion which has not yet been processed, thereby easily realizing full automatization of steps of producing a band blade which does not produce scrap material causing material loss.

It is a still further object of the present invention to provide a method of bending a strip material in which, when plural portions of an edged strip material are automatically bent in a sequential manner, the plural bent portions are accurately determined.

It is a still further object of the present invention to provide an apparatus for bending a strip material which is an apparatus for automatically bending plural portions of an edged strip material in a sequential manner, and in which, irrespective of the degree of the bending angle of each of the portions, the pulled-out amount by which the strip material is pulled out from an outlet of a stationary die in accordance with the bending process can be accurately considered in the feeding amount of the strip material.

It is a still further object of the present invention to enhance the accuracy of notching positions in an automatic band blade producing apparatus in which a notching apparatus and a bending apparatus are integrated with each other.

The method of producing a band blade of the present invention is a method of producing a band blade consisting of an edged strip material in which notches recessed in the width direction are formed in predetermined portions in the longitudinal direction and predetermined portions are bent, wherein a notch recessed in the width direction is formed in a process object region including a front end portion of a long straight edged strip material, the process object region is then bent into a predetermined shape, and the process object region in which the notching process and the bending process have been completed is cut off from a not-yet-processed region which elongates from the process object region.

According to the present invention, when a process object region of an edged strip material is to be subjected to notching and bending processes, the not-yet-processed region can be used as a portion which is to be clamped or held by hand. Since the portion which has been subjected to the notching and bending processes is cut off from the not-yet-processed region. Therefore, it is not required to cut off a part which is used as a portion clamped or held by hand when the process object region is processed, and hence the part can be used as a process object region in the next process.

In the method of producing a band blade according to another aspect of the present invention, a bending apparatus comprising a stationary die and a presser which presses a predetermined portion of an edged strip material fed out from an outlet of the stationary die against a shaping face formed on the outlet, thereby bending the strip material by a predetermined angle, and a notching apparatus having a function of notching an appropriate portion of the edged strip material are used. A process object region including a front end portion of a long straight edged strip material which is passed through the outlet of the stationary die of the bending apparatus is fed to the notching apparatus, thereby performing a notching process in which notches recessed in the width direction are formed in the process object region. A predetermined length of the process object region of the edged strip material which has been subjected to the notching process is pulled into through the outlet of the stationary die of the bending apparatus, a predetermined portion of the process object region of the edged strip material is opposed to the shaping face of the outlet of the stationary die, and the predetermined portion of the process object region is pressed against the shaping face of the outlet by the presser, thereby performing a bending process in which the process object region is bent into a desired shape. Thereafter, the process object region which has been subjected to the notching process and the bending process is cut off from a not-yet-processed region which elongates from the process object region.

According to the present invention, the notching process and the bending process can be continuously conducted in this sequence by using the bending apparatus and the notching apparatus which are arranged in the direction of feeding the edged strip material. In the processes, the not-yet-processed region can be used as a portion for providing a feeding force to the edged strip material, or as a portion for supporting the edged strip material at a predetermined position. The not-yet-processed region which has been used as described above is caused by cutting off the process object region to function as the next process object region and then subjected to the notching process and the bending process. The method of the present invention may be controlled by a computer so as to be automatized.

In the method of producing a band blade, preferably, the process object region fed to the notching apparatus is intermittently moved in the longitudinal direction, and a notch is formed by the notching apparatus at a predetermined position in the process object region in a period when the movement is stopped, thereby forming a notch in plural portions of the process object region in the longitudinal direction. According to this configuration, notches are successively formed in plural arbitrary portions of the process object region of the edged strip material. In this case, since the edged strip material has not yet been subjected to the bending process, the entrance and exit of the edged strip material through the outlet of the stationary die in the movement of the process object region in the longitudinal direction can be performed without hindrance. In the present invention, the control of the movement of the process object region in the longitudinal direction, and that of the operation of the notching apparatus may be controlled by a computer so as to be automatized.

In the method of producing a band blade, after a predetermined length of the process object region of the edged strip material which has been subjected to the notching process is pulled into through the outlet of the stationary die of the bending apparatus, operations of intermittently feeding out the process object region from the outlet so that different portions of the process object region are opposed to the shaping face of the outlet, and, in a period when the feeding of the process object region is stopped, moving the presser by a predetermined width thereby pressing the portion of the process object region opposing the shaping face against the shaping face so as to be bent by a predetermined angle are repeated, whereby the portion can be bent as a whole into a curved shape. According to this configuration, portions which are successively opposed to the shaping face of the outlet of the stationary die are individually bent by the same angle. When the bending angle in one bending operation and the number of bending operations are controlled by a computer, therefore, the process object region is provided with a part which as a whole has a curved shape. When the intervals of the bent portions are made uniform, for example, an arcuate curved part which has a desired radius of curvature as a whole can be accurately formed by controlling the bending angle. Only one portion of the process object region which is opposed to the shaping face may be bent.

In the method of producing a band blade, preferably, after the process object region is subjected to the nothing process and the bending process, the boundary portion between the process object region and the not-yet-processed region is fed to the notching apparatus by feeding out the edged strip material through the outlet of the stationary die of the bending apparatus, and the boundary portion is cut off by the notching apparatus. According to this configuration, in the operation of cutting off the process object region from the not-yet-processed region, no special cutting apparatus is required and the notching apparatus can be used for the purpose in place of such a cutting apparatus. When an automatic band blade producing apparatus in which a notching apparatus and a bending apparatus are integrated with each other is to be manufactured, therefore, it is not required to additionally dispose a cutting apparatus with the result that the producing apparatus can be miniaturized.

In the method of producing a band blade, preferably, a material drawn out from a roll in which a hoop material is wound in a coil-like shape is used as the long straight edged strip material. According to this configuration, an edged strip material is drawn out from a roll in which a hoop material is wound in a coil-like shape, the notching and bending processes are conducted on the process object region of the strip material, the process object region is cut off from the not-yet-processed region, and thereafter the not-yet-processed region can be used as a process object region in the next process. Therefore, full automatization of steps of producing a band blade which does not produce scrap material causing material loss can be realized.

In the method of producing a band blade, preferably, a portion of the edged strip material which has not yet reached the outlet of the stationary die of the bending apparatus is supported by a feed roller, and the feeding of the edged strip material and the movement in the longitudinal direction are controlled by the rotation of the feed roller. According to this configuration, the support of the edged strip material is conducted by the feed roller, and the feeding of the edged strip material and the movement in the longitudinal direction are performed by the rotation of the feed roller. Therefore, the present invention is useful in a full automatic apparatus which executes the method of the present invention.

The method of bending a strip material of the present invention is a method in which a feed roller which is connected to a rotation shaft of a servomotor in a state where idle rotation is inhibited makes contact with the strip material, the feed roller being intermittently rotated by the servomotor and able to idle in a period when the operation of the servomotor is suspended, and, while the strip material is intermittently fed out through a slit formed in a stationary die by the intermittent rotation of the feed roller, a process is repeatedly conducted in which the strip material is pressed against a shaping face of an outlet of the slit by a presser every time the feeding of the strip material is stopped by the suspension of the servomotor, thereby bending the strip material, wherein, a pulled-out amount from a bend start point to a bend end point of the strip material when the strip material is pulled out from the outlet as the strip material is pressed against the shaping face of the outlet of the stationary die and bent is measured by an encoder which is attached to the rotation shaft of the servomotor which idles together with the feed roller which has made contact with the strip material, and the feed roller is rotated by operating the servomotor by a rotation number in which the measured value of the encoder is considered, thereby feeding out the strip material from the outlet of the slit to a position where the bend start point of the strip material in a next bending process corresponds to the shaping face of the outlet of the stationary die.

According to the method of bending a strip material of the present invention, each time one of the plural portions of the strip material in which the plural portions are to be bent is subjected to the bending process, the pulled-out amount of the strip material which is pulled out from the outlet of the slit as the strip material is bent is measured accurately actually by the encoder via the idling of the servomotor which follows the movement of the strip material at this time, and the measured value is considered in the feeding distance of the strip material which is to be used in the next bending process. Thereafter, the bend start points of the plural portions of the strip material can correspond sequentially accurately to the shaping face of the outlet of the slit of the stationary die.

The method of bending a strip material according to another aspect of the present invention is a method in which, while a strip material is intermittently fed out through a slit formed in a stationary die by an intermittent rotation of a feed roller which has made contact with the strip material, a process is repeatedly conducted in which the strip material is pressed against a shaping face of an outlet of the slit by a presser every time the feeding of the strip material is stopped, thereby bending the strip material, wherein a measuring roller which makes contact with the strip material is rotated following the movement of the strip material conducted when the strip material is pulled out from the outlet of the slit as the strip material is pressed against the shaping face of the outlet of the stationary die and bent, a pulled-out amount from a bend start point to a bend end point of the strip material when the strip material is pulled out from the outlet of the slit is measured by an encoder which is attached to the measuring roller, and the feed roller is rotated by a rotation number in which the measured value of the encoder is considered, thereby feeding out the strip material from the outlet of the slit to a position where the bend start point of the strip material in a next bending process corresponds to the shaping face of the outlet of the stationary die.

According to the method of bending a strip material of the present invention, each time one of the plural portions of the strip material in which the plural portions are to be bent is subjected to the bending process, the pulled-out amount of the strip material which is pulled out from the outlet of the slit as the strip material is bent is measured accurately by the encoder via the rotation of the measuring roller which follows the movement of the strip material at this time. The measured value is considered in the feeding amount of the strip material in the next bending process. Therefore, the bend start points of the plural portions of the strip material can correspond sequentially accurately to the shaping face of the outlet of the slit of the stationary die.

According to the present invention, particularly, even when the strip material pulled in the bending process slips with respect to the feed roller, the measuring roller is rotated following the movement of the strip material at this time, and the pulled-out amount of the strip material is measured accurately by the encoder via the rotation of the measuring roller. Therefore, it is not required to control the motor for rotating the feed roller so as to idle in the bending process.

The apparatus for bending a strip material of the present invention comprises: a stationary die having a slit through which the strip material is to be passed; a presser which is reciprocally movable along a path crossing a vicinity of an outlet of the slit and which presses the strip material passed through the slit, against a shaping face of the outlet of the slit, thereby bending the strip material; a servomotor; a feed roller which is connected to a rotation shaft of the servomotor in a state where idle rotation is inhibited and which is able to idle in a period when the operation of the servomotor is suspended, and which has made contact with the strip material, thereby imparting a feeding force to the strip material; an encoder which is attached to the rotation shaft of the servomotor and which measures a rotation amount of the feed roller; and a control unit which controls a rotation number of the rotation shaft of the servomotor on the basis of a pulse signal generated by the encoder.

The apparatus for bending a strip material according to another aspect of the present invention comprises: a stationary die having a slit through which the strip material is to be passed; a presser which is reciprocally movable along a path crossing a vicinity of an outlet of the slit and which presses the strip material passed through the slit, against a shaping face of the outlet of the slit, thereby bending the strip material; a feed roller which is rotated by a motor and which has made contact with the strip material, thereby imparting a feeding force to the strip material; a measuring roller which has made contact with the strip material and which is rotated following a movement of the strip material; an encoder which measures a rotation amount of the measuring roller; and a control unit which controls a rotation number of a rotation shaft of the motor on the basis of a pulse signal generated by the encoder.

According to the apparatuses for bending a strip material of these aspects of the present invention, it is possible to provide a bending apparatus which can accurately perform the above-mentioned methods of bending a strip material.

DETAILED DESCRIPTION OF THE PREFERRED EMBODIMENT

FIGS. 1 to 4 are diagrams illustrating a method of producing a band blade according to an embodiment of the present invention. In these figures, 11 designates a notching apparatus, 31 designates a bending apparatus, and 51 designates feed rollers.

Before the production method is described, the configurations of the notching apparatus 11, the bending apparatus 31, and the feed rollers 51 will be briefly described.

Figure 13:
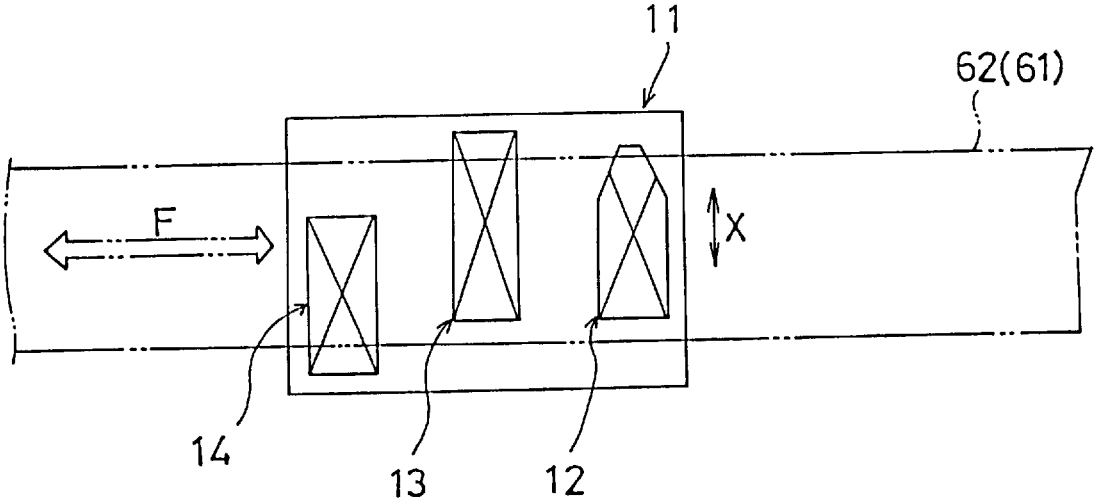
FIG. 13 is a diagram showing the relationship between the moving direction of the notching apparatus and that of the edged strip material.
Figure 14:
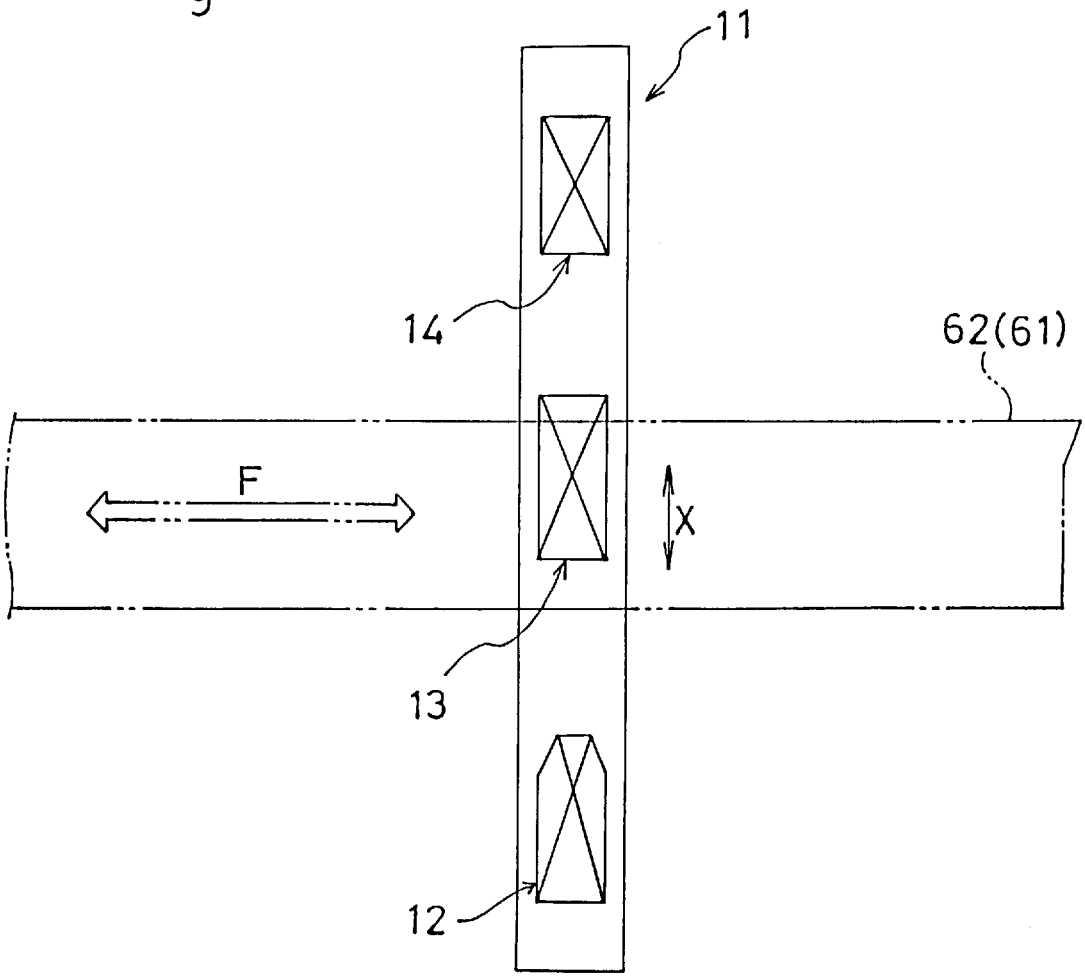
FIG. 14 is a diagram showing the relationship between the moving direction of a notching apparatus of another type and that of the edged strip material.

The notching apparatus 11 has functions of cutting off a predetermined portion of an edged strip material 61 which will be described later, and notching an appropriate portion of a process object region 62 of the strip material 61. The illustrated notching apparatus 11 comprises three press dies 12, 13, and 14. The dies 12, 13, and 14 consist of female dies 12*a*, 13*a*, and 14*a*, and male dies 12*b*, 13*b*, and 14*b*, respectively. In the notching apparatus 11, the three press dies 12, 13, and 14 may be arranged in the feeding direction (coincident with the longitudinal direction) F of the edged strip material 61 as shown in FIG. 13, or alternatively in directions X perpendicular to the feeding direction F (hereinafter, referred to as the vertical directions X) as shown in FIG. 14. The timing for die matching for the press dies 12, 13, and 14 are controlled by a computer. In the case where the press dies 12, 13, and 14 are arranged in the feeding direction F, each of the press dies 12, 13, and 14 can be independently moved in the vertical direction X. The movement of each die and the position after the movement are controlled by a computer.

Figure 16:
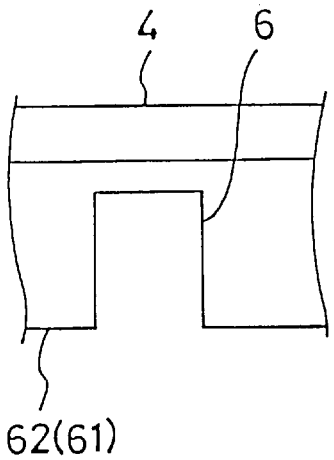
FIG. 16 is a diagram showing a notch which is formed by a bridge-cut press die.
Figure 17:
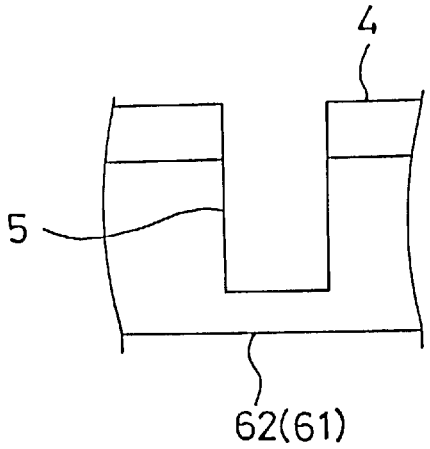
FIG. 17 is a diagram showing another notch which is formed by a straight-cut press die.
Figure 18:
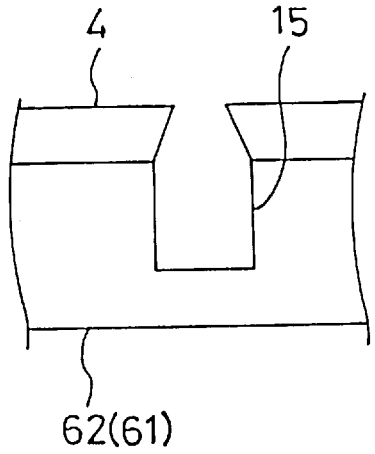
FIG. 18 is a diagram showing a notch which is formed by a square-cut press die.
Figure 19:
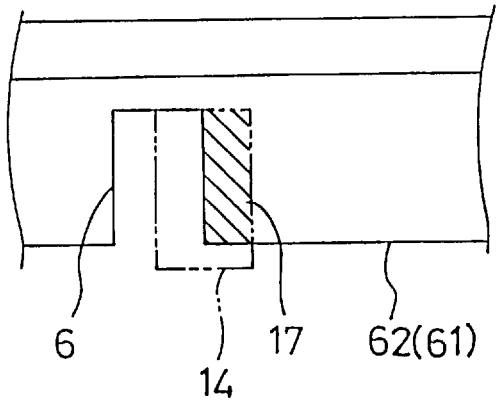
FIG. 19 is a diagram showing a case where the width of a notch is increased by a bridge-cut press die.
Figure 20:
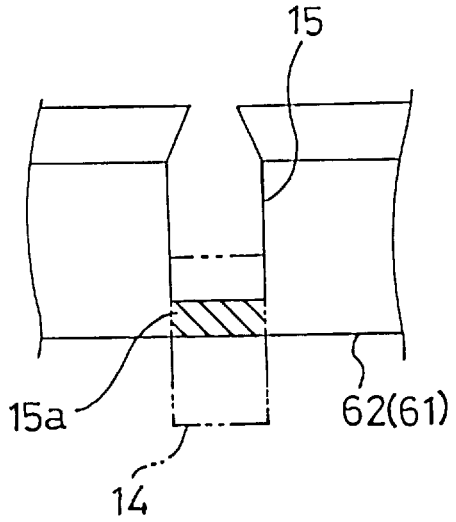
FIG. 20 is a diagram showing a case where the edged strip material is cut off by a bridge-cut press die.
Figure 21:
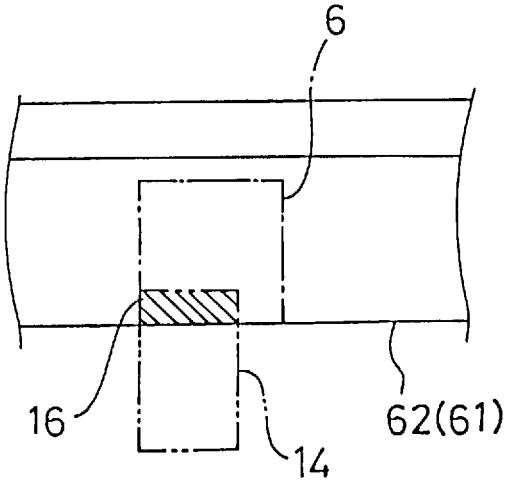
FIG. 21 is a diagram showing a case where a notch which is larger than a male die is formed by a bridge-cut press die.
Figure 22:
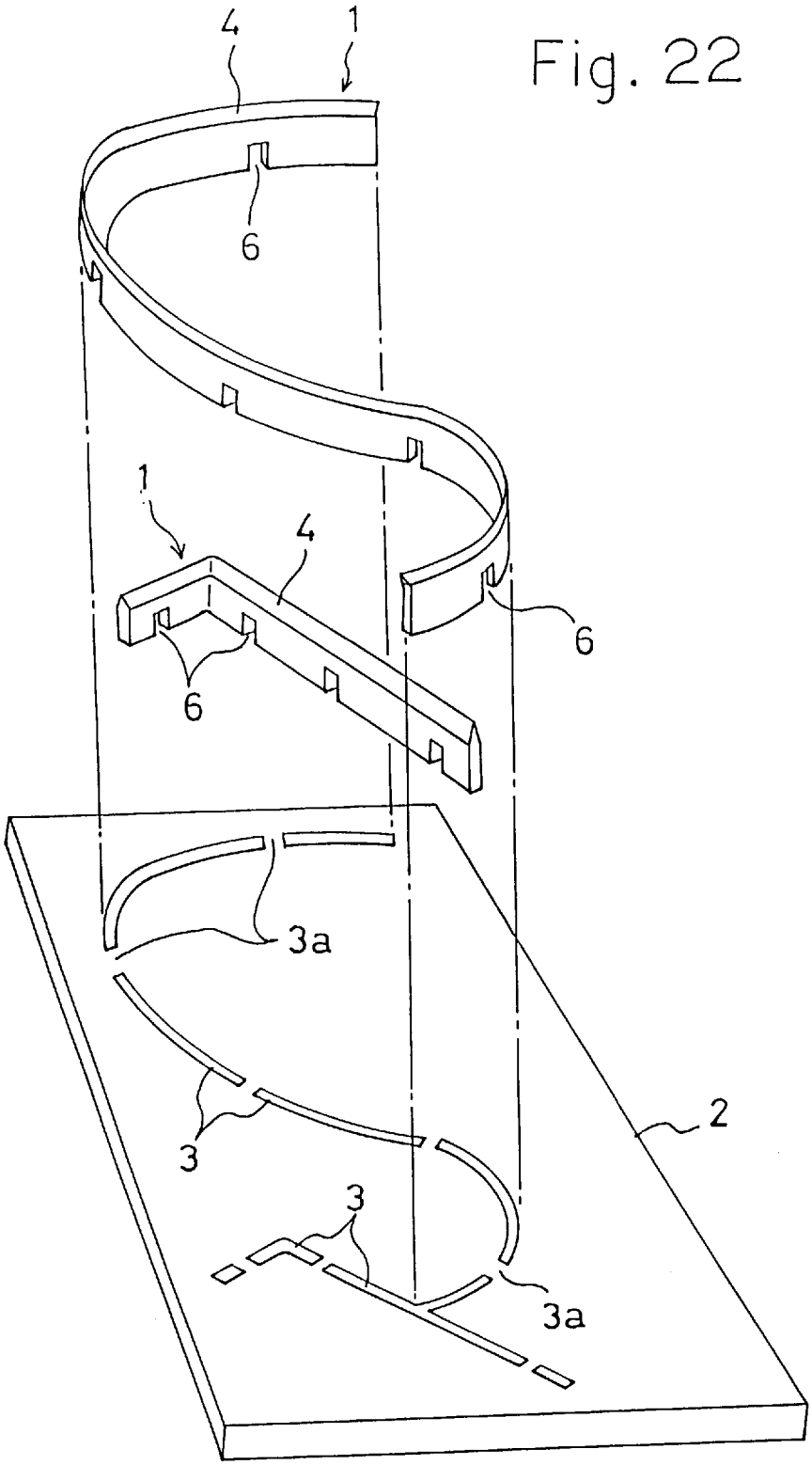
FIG. 22 is an exploded perspective view of a Thomson blade wooden model.

The press die 12 is used for a so-called square cut. When the die is matched, as shown in FIG. 18, a notch 15 which is recessed in the width direction from the side of an edge 4 of the process object region 62 can be formed by punching. The press die 13 is used for the so-called straight cut. When the die is matched, as shown in FIG. 17, a straight hole 5 which is recessed in the width direction from the side of the edge 4 of the process object region 62 can be formed by punching. The press die 14 is used for the so-called bridge cut. When the die is matched, as shown in FIG. 16, a U-shaped notch 6 which is recessed in the width direction from the side of the back of the process object region 62 can be formed by punching. When the bridge-cut press die 14 is moved to a desired position in the vertical direction X, furthermore, a remaining part 15*a* (hatched part) of the square-cut hole 15 formed by the square-cut press die 12 can be cut by using the press die 14 as shown in FIG. 20 so that the edged strip material 61 is cut off. When the bridge-cut press die 14 is moved to a desired position in the vertical direction X, similarly, the notch depth of the notch 6 of FIG. 16 can be increased by using the press die 14. When the movement of the edged strip material 61 in the longitudinal direction is conjointly employed, furthermore, the width of the notch 6 can be increased as shown in FIG. 19. Therefore, the notch 6 which is indicated by a one-dot chain line in FIG. 21 and which is larger in notch depth and width than the press die 14 can be processed and formed in the edged strip material 61. The hatched parts 17 and 16 in FIGS. 19 and 21 indicate overlap parts between the edged strip material 61 and the female die 14*b* of the bridge-cut press die 14.

Figure 15:
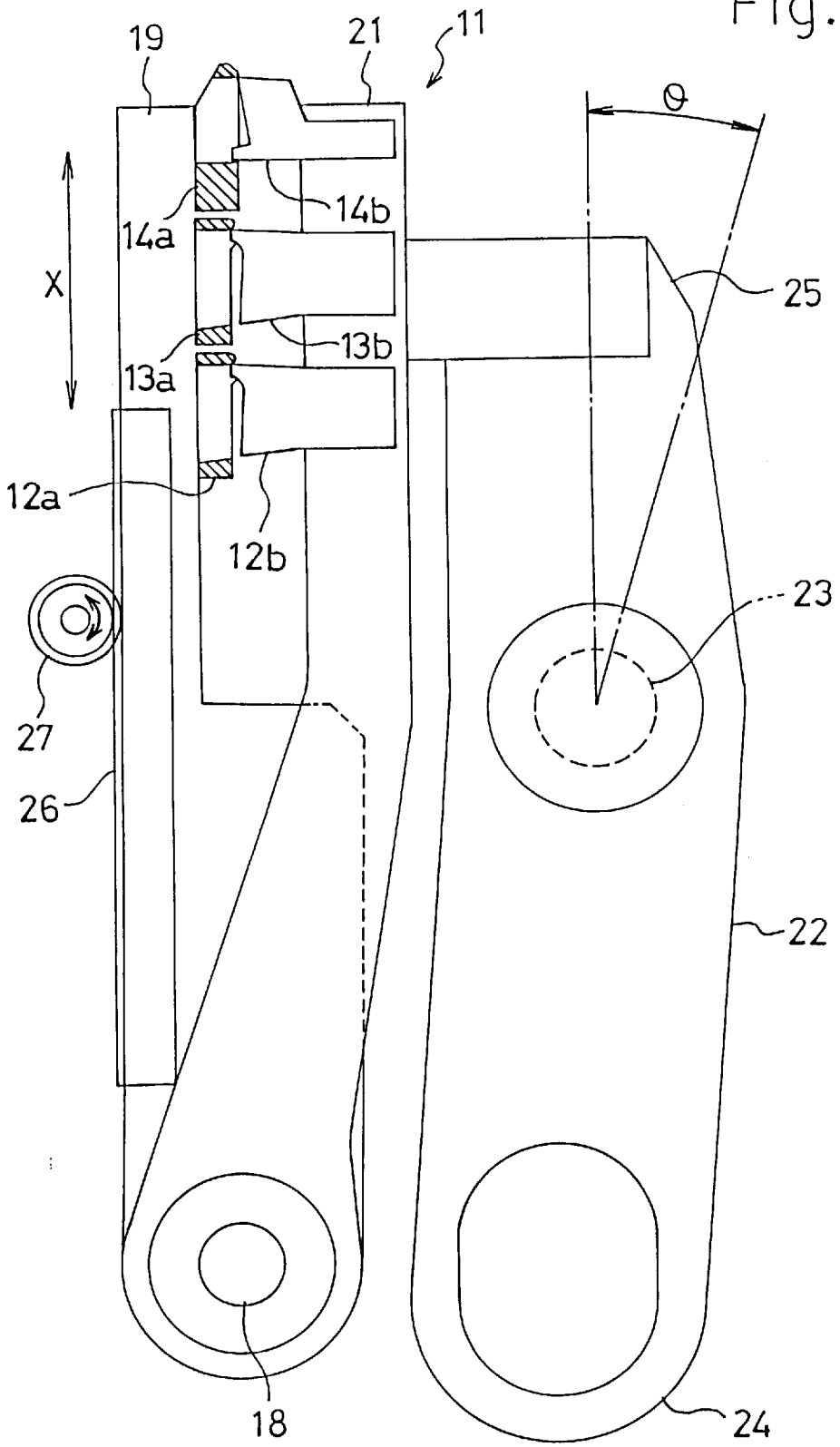
FIG. 15 is a partial sectional side view schematically showing a specific example of a notching apparatus.

FIG. 15 is a diagram of a specific example of the notching apparatus 11. In the notching apparatus 11, the female dies 12*a*, 13*a*, and 14*a* are arranged on one of a pair of arms 19 and 21 which are coupled to each other at the base end by a pin 18, i.e., on the arm 19, the male dies 12*b*, 13*b*, and 14*b* are arranged on the other arm 21, and the other arm 21 is swingingly opened or closed with respect to the one arm 19, thereby allowing the three press dies 12, 13, and 14 to be opened or matched. The reference numeral 22 designates an opening and closing lever. The center part of the lever 22 is supported in a swingable manner by a pin 23, the base end 24 is connected to a swinging mechanism which is not shown, and the front end 25 is connected to the other arm 21. In FIG. 15, 26 designates a rack, and 27 designates a pinion. These components are used for moving the notching apparatus 11 in the vertical direction X. The reference symbol θ indicates the maximum mold opening angle.

The bending apparatus 31 comprises a stationary die 32, and a pair of pressers 33 and 34. The pair of pressers 33 and 34 can be integrally formed by partially cutting away a cylinder which is fitted onto the stationary die 32. An outlet 35 of the stationary die 32 is provided with a pair of shaping faces 36 and 36 which oppose each other. The shaping faces 36 and 36 are pointed at an acute angle. Therefore, the outlet 35 of the stationary die 32 is tapered. The pressers 33 and 34 are configured so as to approach and separate from the outlet 35 along an arcuate path A—A. Specifically, the pressers can be moved from one side of the outlet 35 to the other side along the arcuate path A—A, or from the other side of the outlet 35 to the one side along the arcuate path A—A. The operations of the pressers 33 and 34 are controlled by the computer.

The feed rollers 51 are paired. One of the feed rollers is used as a driving feed roller, and the other feed roller as a pressing feed roller. The pair of feed rollers 51 sandwich and support a portion of the edged strip material 61 which has not yet reached the outlet 35 of the stationary die 32. The feeding and movement in the longitudinal direction of the edged strip material 61 are controlled by the rotation of the feed roller 51. The rotation of the feed roller 51 which is used as a driving feed roller is controlled by the computer.

A method of producing a band blade according to an embodiment of the present invention will be described.

Figure 1:
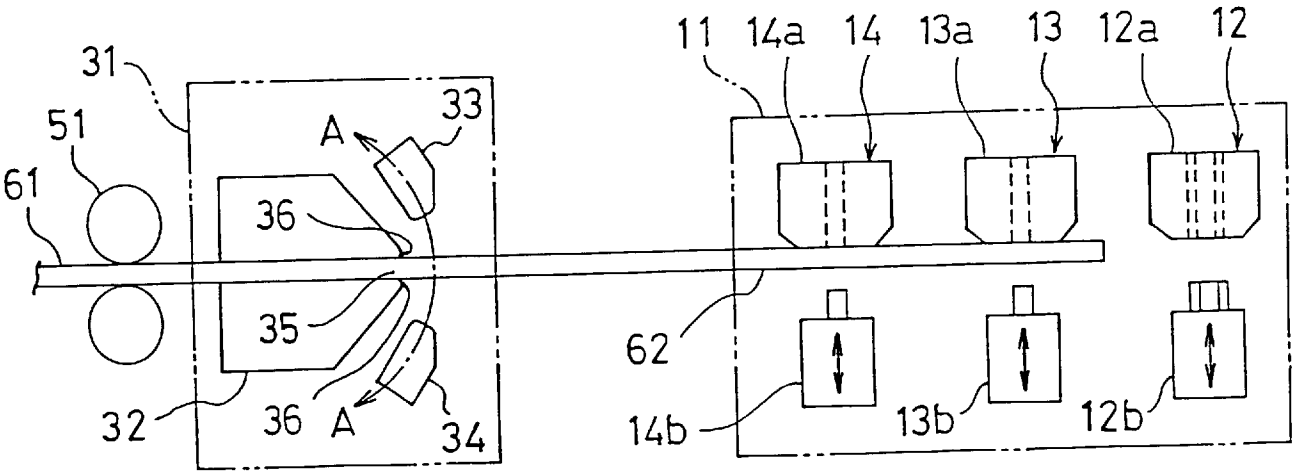
FIG. 1 is a diagram showing a state where a process object region of a long straight edged strip material is fed to a notching apparatus.

FIG. 1 shows a state where the process object region 62 including the front end of the long straight edged strip material 61 which has passed through the outlet 35 of the stationary die 32 of the bending apparatus 31 is fed to the notching apparatus 11. In this state, the three press dies 12, 13, and 14 of the notching apparatus 11 are opened, and the pressers 33 and 34 of the bending apparatus 31 are at a nonoperation position. The long straight edged strip material 61 is drawn out from a roll (not shown) in which an edged hoop material made of steel is wound in a coil-like shape, and shaped as required into a straight shape at a position which has not yet reached the feed rollers 51, so that the curl of the hoop material is eliminated. In order to pass the edged strip material 61 through the outlet 35 of the bending apparatus 31, the edged strip material 61 must be straight. If the edged strip material 61 is curved, it cannot be passed through the outlet 35 or the control operation of moving the edged strip material 61 through the outlet 35 in the longitudinal direction cannot be smoothly performed. In the edged strip material 61, the process object region 62 is previously determined. Under the control of the computer, notching and bending processes which will be described later are performed on the process object region 62.

Figure 2:
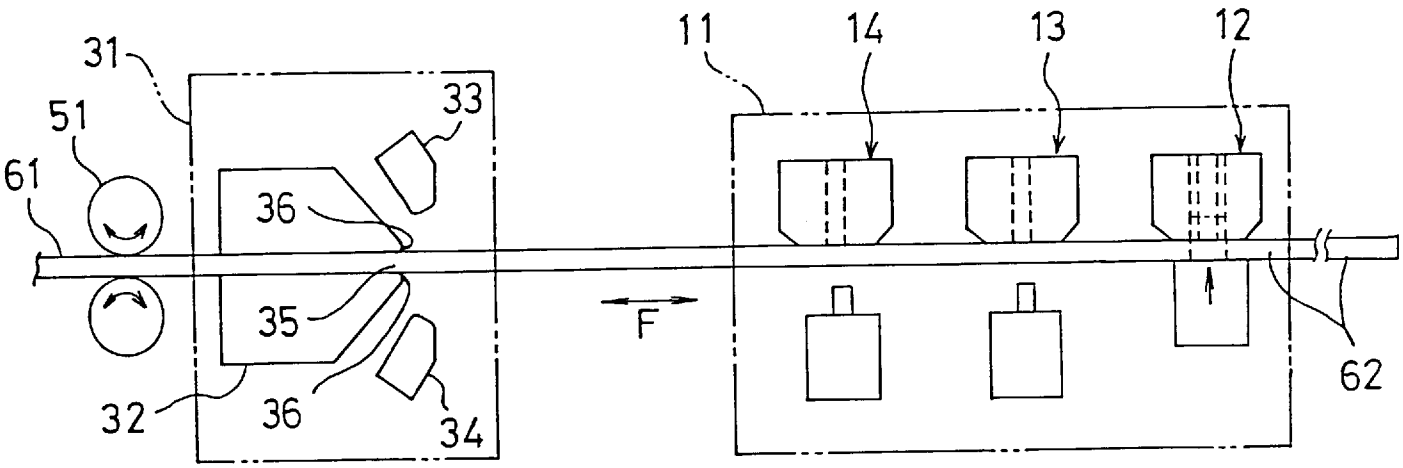
FIG. 2 is a diagram showing a step of square-cutting a boundary portion between a process object region of the edged strip material and a not-yet-processed region.
Figure 3:
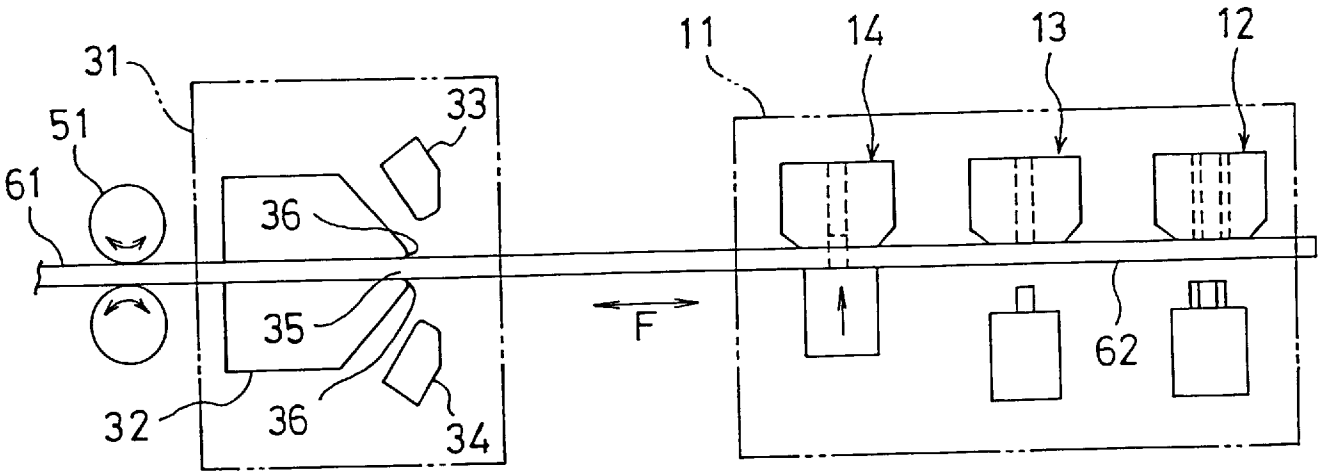
FIG. 3 is a diagram showing another step of forming a notch in the process object region of the edged strip material.

FIG. 2 shows a step in which the process object region 62 that was previously processed is cut off by matching the square-cut press die 12. FIG. 3 shows a step in which a notch 6 that is recessed in the width direction at a predetermined portion of the process object region 62 is formed by matching the bridge-cut press die 14.

Figure 5:
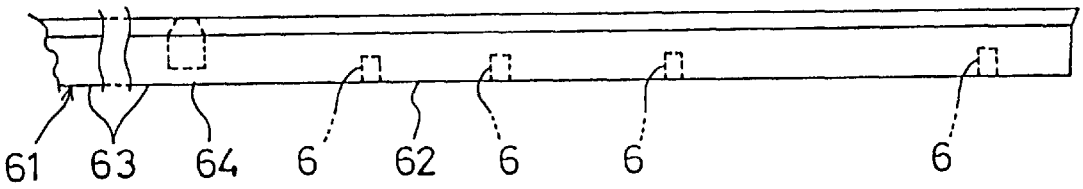
FIG. 5 is a diagram showing a portion to be notched which is set in the process object region of the edged strip material
Figure 6:
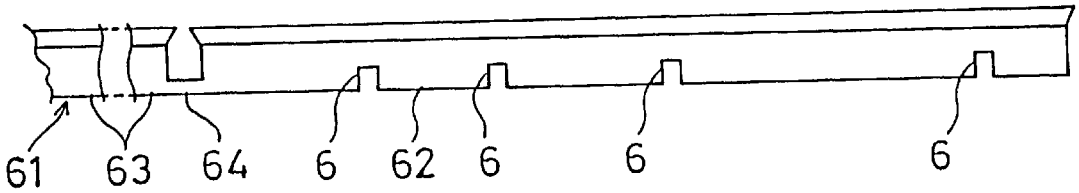
FIG. 6 is a diagram showing a state where notches and the like are formed in the process object region of the edged strip material.

In the process object region 62 of the edged strip material 61, portions where a boundary portion 64 between the process object region 62 and a not-yet-processed region 63, or the notch 6 is to be formed are previously determined. In FIG. 5, portions to be notched which are determined as described above are indicated by broken lines. The rotation of the feed roller 51 causes the edged strip material 61 to be intermittently moved (fed or pulled) in the longitudinal direction of the strip material, so that the boundary portions 64 and the portions to be notched are made correspondent in a predetermined sequence to the square-cut press die 12 or the bridge-cut press die 14. When the movement of the strip material is stopped, the press die 12 or 14 is appropriately matched so that a notch is formed at the corresponding portion. As a result of these operations, as shown in FIG. 6, the notches 6 are actually formed in the portions to be notched. With respect to the boundary portions 64, the straight-cut press die 13 may be used.

The edged strip material 61 in which the boundary portions 64 are subjected in this way to square-cutting and the notches 6 are formed in the predetermined portion of the process object region 62 are then caused by the rotation of the feed roller 51 to be pulled by a predetermined length through the outlet 35 of the stationary die 32 of the bending apparatus 31, and then subjected to the next bending process. The pulled-in amount is determined in accordance with the shape of a band blade 1 which is a final product. Specifically, the strip material is pulled into the bending apparatus 31 until the portion of the process object region 62 which is to be bent opposes the shaping faces 36 of the outlet 35.

FIGS. 7 to 10 show a bending step in which the predetermined portion of the process object region 62 is bent into an arcuate shape.

In the bending step, after the front end of the process object region 62 is set (the front end reference is positioned), the feed rollers 51 are rotated, whereby the process object region 62 of the edged strip material 61 which has been subjected to the notching process is intermittently fed out from the outlet 35 of the stationary die 32 of the bending apparatus 31 so that different portions of the process object region 62 are opposed to the shaping faces 36 of the outlet 35, and, in a period the feeding of the process object region 62 is stopped, the pressers 33 and 34 (in FIG. 7, the presser 34 is omitted) are moved by a predetermined width, whereby the portion of the process object region 62 which opposes the shaping face 36 is pressed against the shaping face 36 so as to be bent by a predetermined angle.

Figure 7:
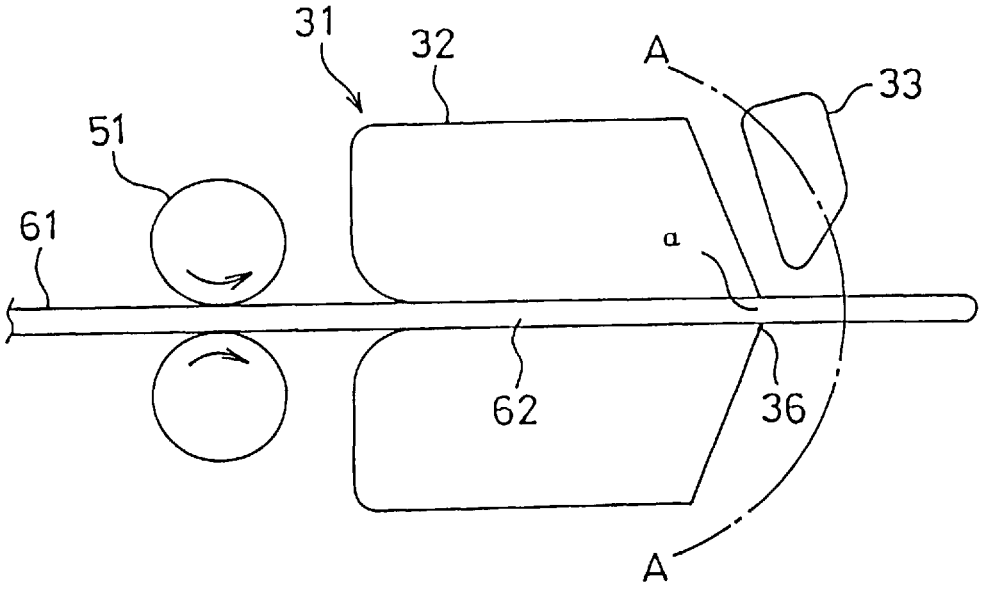
FIG. 7 is a diagram showing an initial stage of the bending process.
Figure 8:
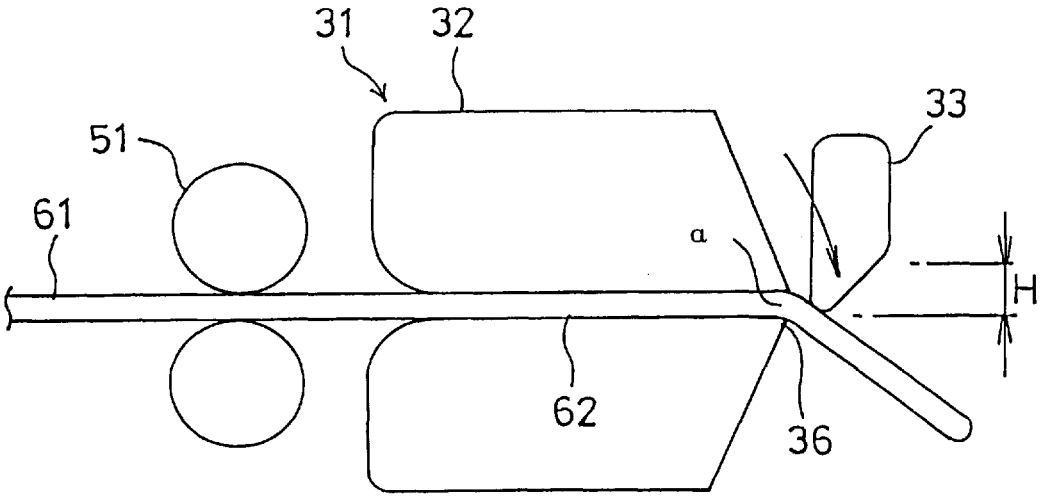
FIG. 8 is a diagram showing a stage where a presser is pressed against the process object region in the bending process.
Figure 9:
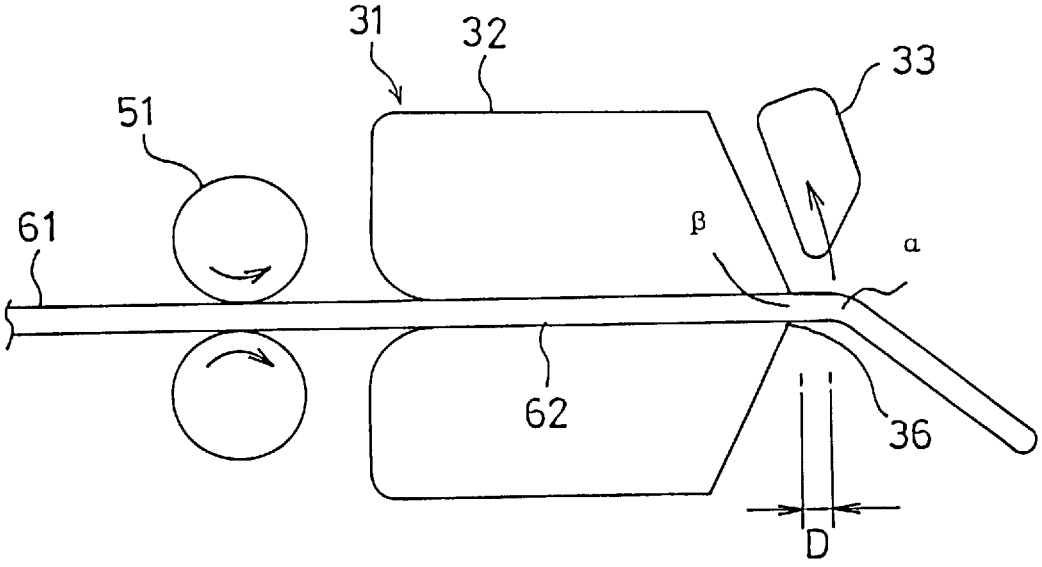
FIG. 9 is a diagram showing a stage where the process object region in the bending process is released from the pressing of the presser.
Figure 10:
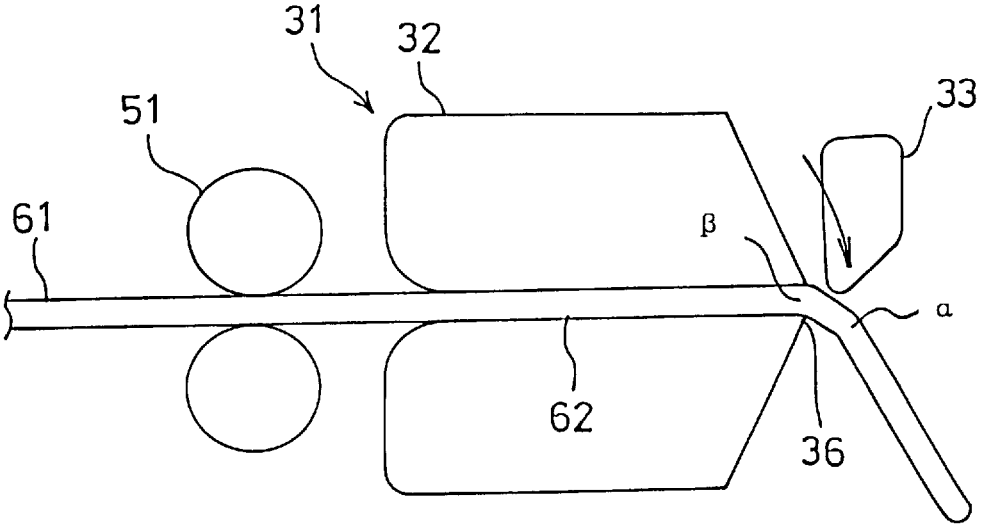
FIG. 10 is a diagram showing a stage where the presser is pressed against another portion of the process object region in the bending process.

Specifically, at the time when a predetermined portion α of the process object region 62 opposes the shaping face 36 as shown in FIG. 7, the feeding of the edged strip material 61 is stopped, and the presser 33 is then moved as shown in FIG. 8, whereby the predetermined portion α of the process object region 62 is pressed against the shaping face 36 and the portion α is bent by the predetermined angle. Thereafter, the presser 33 is retracted to the original position as shown in FIG. 9, the feed roller 51 is rotated by a predetermined angle so that a position β separated by a predetermined width from the portion α which has been bent opposes the shaping face 36, and then the feeding operation is stopped. Thereafter, the presser 33 is again moved so that the predetermined position β the process object region 62 is pressed against the shaping face 36 as shown in FIG. 10, thereby bending the portion at a constant angle. When the above-mentioned operations are repeated, the process object region 62 is bent at plural portions which are arranged at predetermined intervals. When the intervals of the bent portions α, β, . . . are relatively small, the strip material is bent as a whole into a curved shape. When the intervals are not constant, several portions which are separated by intervals are respectively bent. In FIGS. 7 to 10, the case where the bending process is conducted by using the one presser 33 has been described. In the case where the bending direction is to be opposite, the other presser 34 and the corresponding shaping face 36 are used.

In the bending process described above, when the moving width H of the presser 33 is constant, the bending angles of the bent portions α, β . . . in each bending operation are equal to each other. When the width D of the intermittent feeding of the edged strip material 61 caused by the feed rollers 51 is constant, the intervals of the bent portions α, β . . . are equal to each other. When an arcuate curved part is to be formed as a whole by the bending process, therefore, the intermittent feeding width D is determined so that portions which are obtained by equally dividing the whole part of the process object region 62 which is to be subjected to the bending process sequentially oppose the shaping face 36, and the number of bending operations is calculated from the bent angle of the predetermined portions α, β . . . which is formed by one pressing of the presser 33, and the raidus of curvature of the curved portion which is to be formed by the bending process. As a result, the bending process of an accurate curved shape can be conducted with using both the elements as factors.

When the process object region 62 is bent, in consideration of the spring back property of the edged strip material 61, it is preferable to set a moving width H of the presser 33 larger than the moving width which corresponds to the bent angle after the spring back.

When an angled corner is to be formed by bending a predetermined portion of the process object region 62, it is required to only press one time the predetermined portion of the process object region 62 by the presser 33 against the shaping face 36. When the process object region 62 is to be bent at a right angle, the moving width H of the presser 33 must be set larger. In a bending operation of forming such a right-angled portion, it is useful to employ a configuration in which the outlet 35 of the stationary die 32 is tapered and the presser 33 can be moved from one side of the outlet 35 to the other side along the arcuate path A—A. This is because of the following reason. When the process object region 62 is bent, the bent portion is slightly returned after the bending operation because of the spring back property. When the process object region 62 is to be pressed by the presser 33 against the shaping face 36 and bent, therefore, the spring back property of the edged strip material 61 is considered. Namely, after the presser 33 is passed below the outlet 35, the presser is further moved so that the process object region 62 is bent at an acute angle which is smaller than a right angle, with the result that, after the presser 33 is retracted, the bent portion is returned to a right angle by the spring back property.

Figure 11:
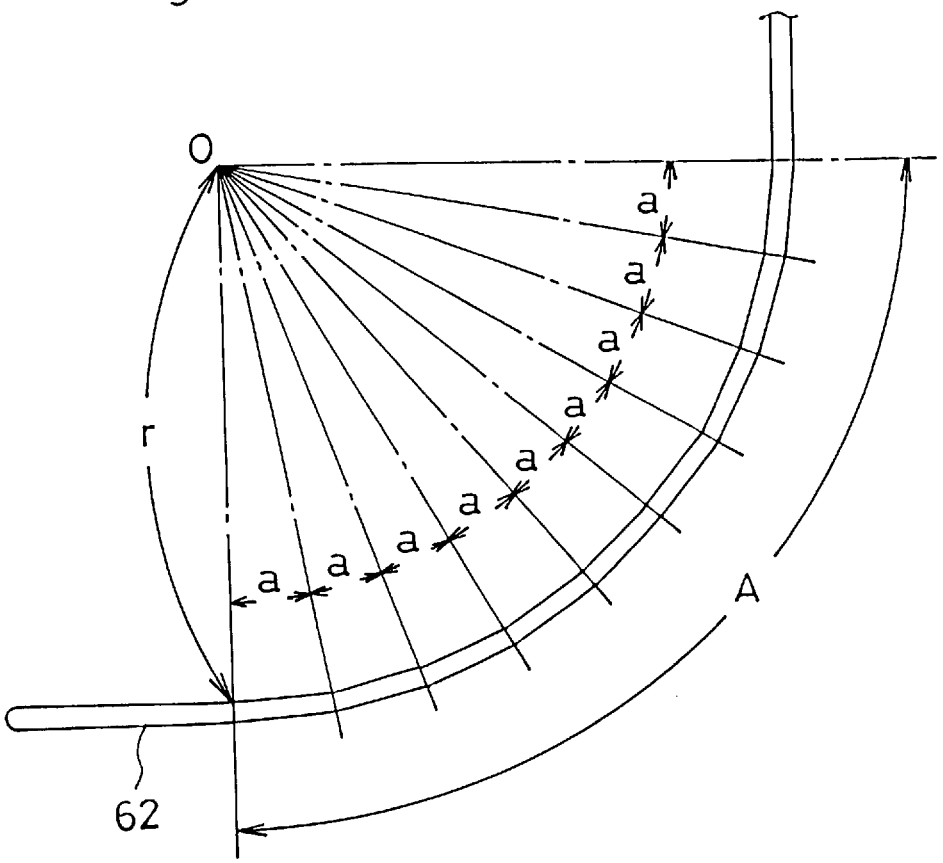
FIG. 11 is a diagram showing a curved part of the process object region which has been subjected to the bending process in accordance with FIGS. 7 to 10.

FIG. 11 shows a curved part of the process object region 62 which has been bent into a curved shape as a whole in accordance with the method illustrated with reference to FIGS. 7 to 10. In FIG. 11, A indicates the opening angle of the ends of the arcuate curved portion which is formed by the bending process, and a indicates an opening angle of one of bent parts which is obtained by equally dividing the opening angle A. The reference symbol r indicates the radius of curvature of the curved portion.

Figure 4:
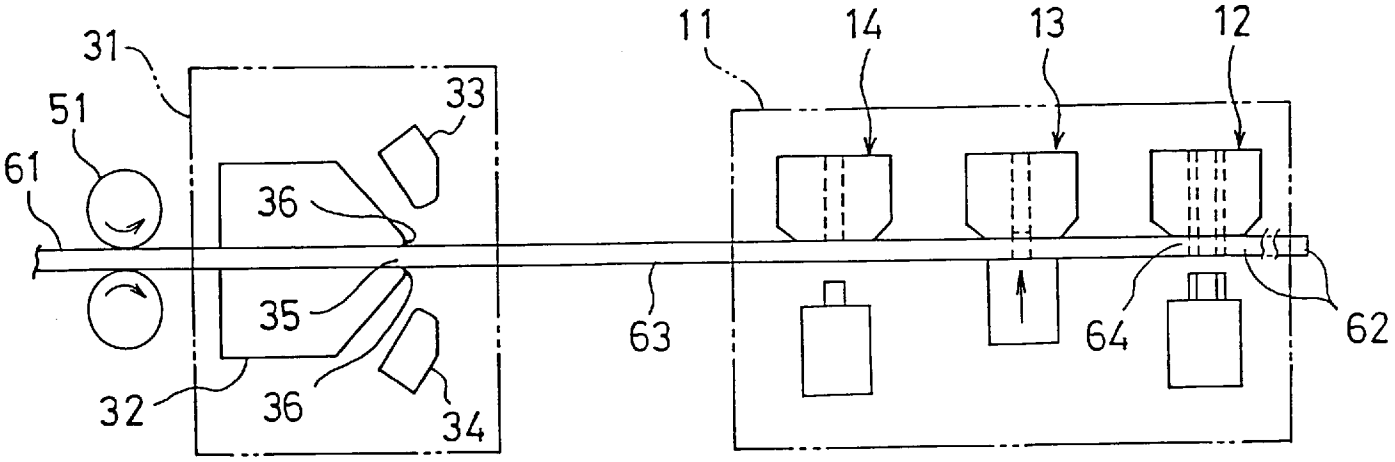
FIG. 4 is a diagram showing a step of cutting off the process object region from the not-yet-processed region.
Figure 12:
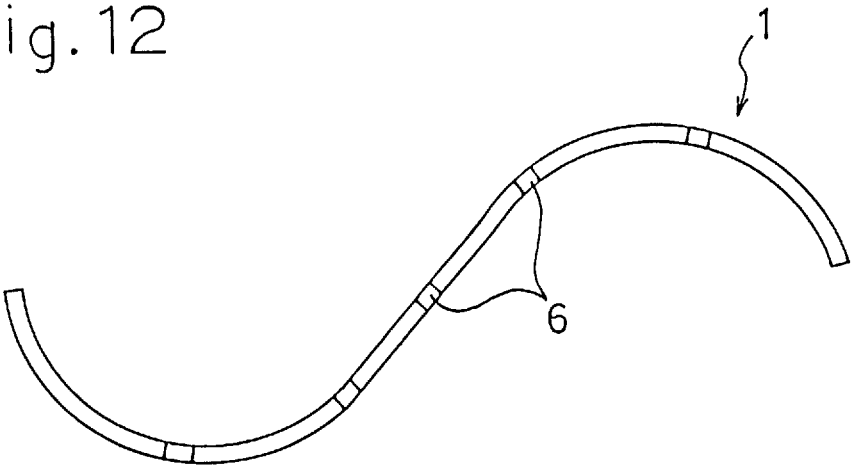
FIG. 12 is a diagram showing the shape of a band blade.

The edged strip material 61 in which the process object region 62 has been subjected to the bending process by the bending apparatus 31 as described above is fed by the rotation of the feed roller 51 as shown in FIG. 4. The boundary portion 64 between the process object region 62 and the not-yet-processed region 63 is made correspondent to the square-cut press die 12. In this state, the square-cut press die 12 is matched and the notch 15 such as that shown in FIG. 18 is formed. Then, the notching apparatus 11 is moved in one of the directions X and thereafter the remaining part 15*a* described with reference to FIG. 20 is cut off. As a result, the process object region 62 in which the notches 5 and 6 are formed is cut off from the not-yet-processed region 63 so that, for example, the band blade 1 such as that shown in FIG. 12 is produced.

Thereafter, the not-yet-processed region 63 is set at this time so as to be a process object region and fed to the notching apparatus 11 as shown in FIG. 1, and the same steps are repeated. Consequently, the band blade 1 is successively produced from the edged strip material 61 drawn out from a roll in which a hoop material is wound in a coil-like shape. In other words, the series of steps ranging from the step of drawing out the edged strip material 61 from the roll to that of cutting off the band blade 1 (the process object region 61), i.e., the series of steps of setting the front end—cutting off the front end by a square-cut or straight-cut press die (as required)—forming a notch by the bridge-cut press die 14 (bridge cut)—cutting off by the bridge-cut press die 14 (end cut)—pulling in the strip material—setting the front end—bending process—and cutting off by the bridge-cut press die 14 can be repeatedly continuously under a computer control without the intervention of an attendant.

In the above-described series of steps, when the process object region 62 of the edged strip material 61 is to be subjected to the process of forming the notches 5 and 6 or the bending process, the rolls 51 support the not-yet-processed region 63 and the process object region 62 of the edged strip material 61. After all the notching and bending processes on the process object region 62 are completed, the process object region 62 is cut off from the not-yet-processed region 63. Therefore, the process object region 62 which has been cut off from the not-yet-processed region 63 can be immediately used as the band blade 1, and it is absolutely unnecessary to perform an end process in which ends are cut off. After the process object region 62 is cut off from the not-yet-processed region 63, moreover, the not-yet-processed region can be used as it is as a new process object region. Therefore, no scrap material due to an end process is produced so that the material loss is reduced.

Figure 23:
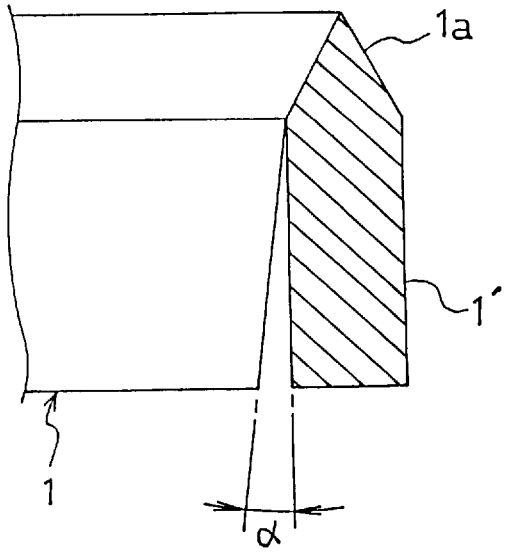
FIG. 23 is a diagram showing a butting portion of the band blade of the Thomson blade wooden model.

In the band blade 1 which is to be used in a Thomson blade wooden model, preferably, each end has a square-cut shape in which the blade is projected from an end face in an edge-like shape as shown in FIG. 23. According to such a configuration, the end of the band blade 1 can closely overlap the blade portion la of another band blade 1'. When, as shown in the figure, the end face of the band blade 1 is inclined by a predetermined angle $\alpha$ with respect to the vertical line, it is possible to absorb the inclination of the other band blade 1' so that the end of the band blade 1 can closely overlap the blade portion 1*a* of the other band blade 1'. In the embodiment, the punched shape formed by the square-cut press die 12 is that of the notch 15 illustrated with reference to FIG. 18, and hence the band blade 1 can have the above-mentioned advantage. When each end of the band blade 1 is to be finished in a straight shape, the notch press die 13 or 14 is used.

FIGS. 24 to 27 and FIG. 30 illustratively show features in configuration of an apparatus for bending a strip material. The bending apparatus is substantially identical with that shown in FIGS. 1 to 4. Namely, the bending apparatus comprises a stationary die 32 having a slit in which the opening width corresponds to the thickness of the edged strip material 61, and a pair of pressers 33 and 34 which are reciprocally movable along an arcuate path A—A crossing the vicinity of an outlet 35 of the stationary die 32 and which presses the edged strip material 61 passed through the outlet 35, against lateral shaping face 36 and 36 of the outlet, thereby bending the strip material. The bending apparatus further comprises: a servomotor 7; a feed roller 51 which is connected to the rotation shaft 71 of the servomotor 7 in a state where idle rotation is inhibited; an encoder 8 which is attached to the rotation shaft 71 of the servomotor 7 and which measures the rotation amount of the feed roller 51; and a control unit 9 which controls the rotation number of the rotation shaft 71 of the servomotor 7 on the basis of a pulse signal generated by the encoder 8.

The feed roller 51 attached to the rotation shaft 71 of the servomotor 7 is used as a driving feed roller, and another feed roller 51 functions as a pressing feed roller. A feeding force due to the rotation of the driving feed roller 51 is given to the edged strip material 61 which is sandwiched by the pair of feed rollers 51. In a period when the operation of the servomotor 7 is suspended, the driving feed roller 51 can idle with being accompanied by the rotation shaft 71 of the servomotor 7.

Figure 30:
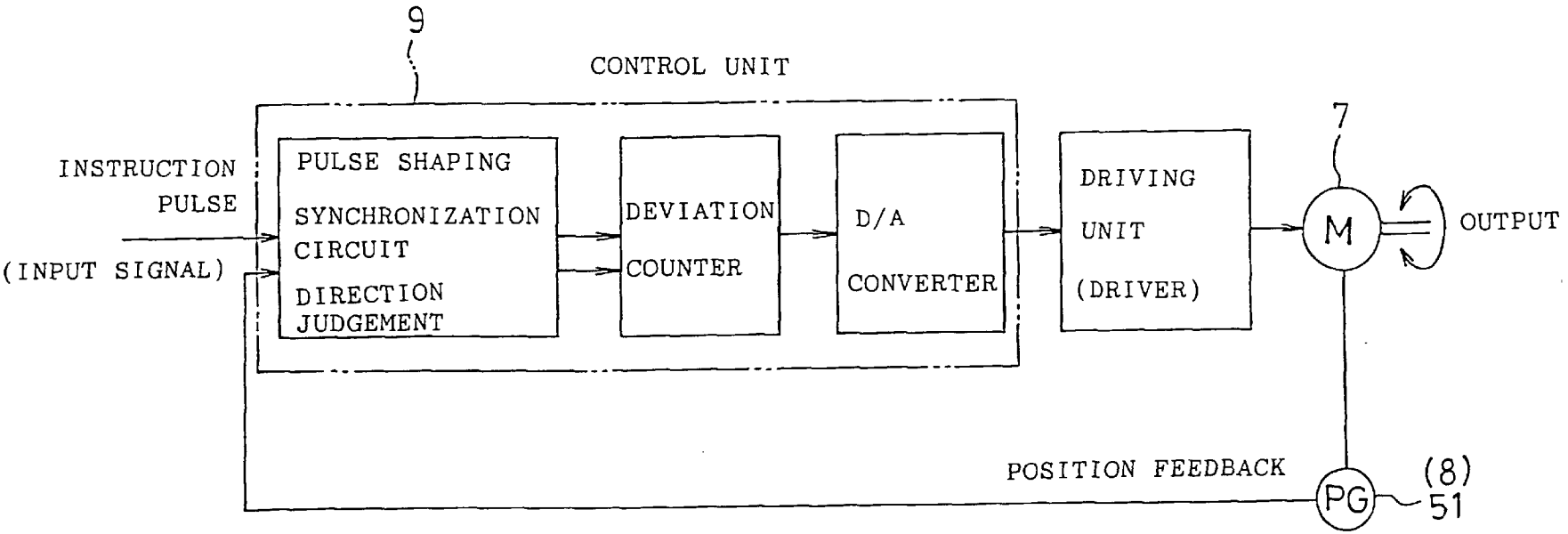
FIG. 30 is a block diagram showing a control unit.

As shown in FIG. 30, an instruction pulse (input signal) is input to the control unit 9. The signal generated by the encoder 8 is fed back to the control unit 9 so that the rotation direction of the rotation shaft 71 of the servomotor 7 is judged, and then input to a deviation counter so that instruction pulses accumulated in the deviation counter is decremented. When the deviation amount becomes zero, the servomotor 7 is stopped. When instruction pulses of a necessary pattern such as operation or stoppage of the servomotor 7 are input, therefore, the addition or subtraction of the pulses is conducted and the servomotor 7 is operated in accordance with the instruction pulses. The rotation number (corresponding to the stop position) of the servomotor 7 depends on the number of the instruction pulses.

The pair of pressers 33 and 34 are moved from right to left or from left to right along the arcuate path A—A, by the operation of a motor which is not shown.

Next, the method of bending the edged strip material 61 will be described.

Figure 24:
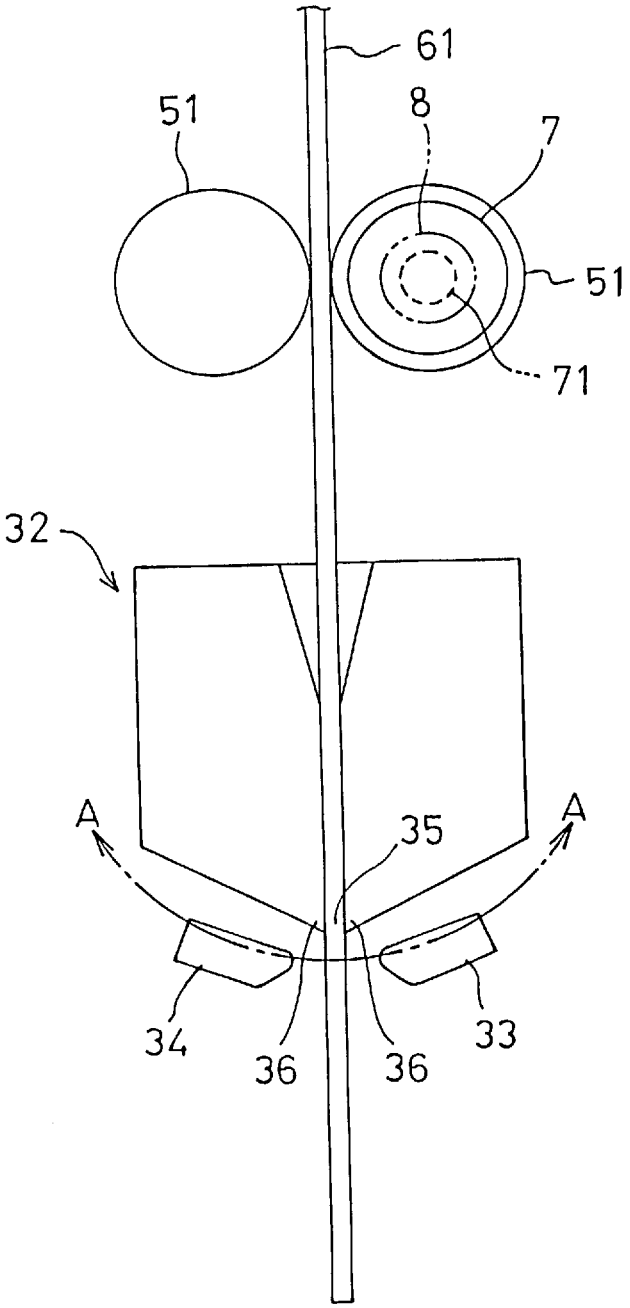
FIG. 24 is a diagram showing a nonoperation state of pressers against a stationary die in a process of bending the strip material.

FIG. 24 shows a nonoperation state of the pressers 33 and 34 against the stationary die 32 in the bending process. The edged strip material 61 is supplied from the rearward side (in the figure, the upper side) between the pair of feed rollers 51 and 51, and intermittently fed to the forward side (in the figure, the lower side) through the outlet 35 of the stationary die 32 by the intermittent rotation of the driving feed roller 51 which is made contact with the edged strip material 61. In a period when the feeding of the edged strip material 61 is stopped, the pressers 33 and 34 are rotated by a predetermined amount in the forward or reverse direction along the arcuate path A—A.

Figure 25:
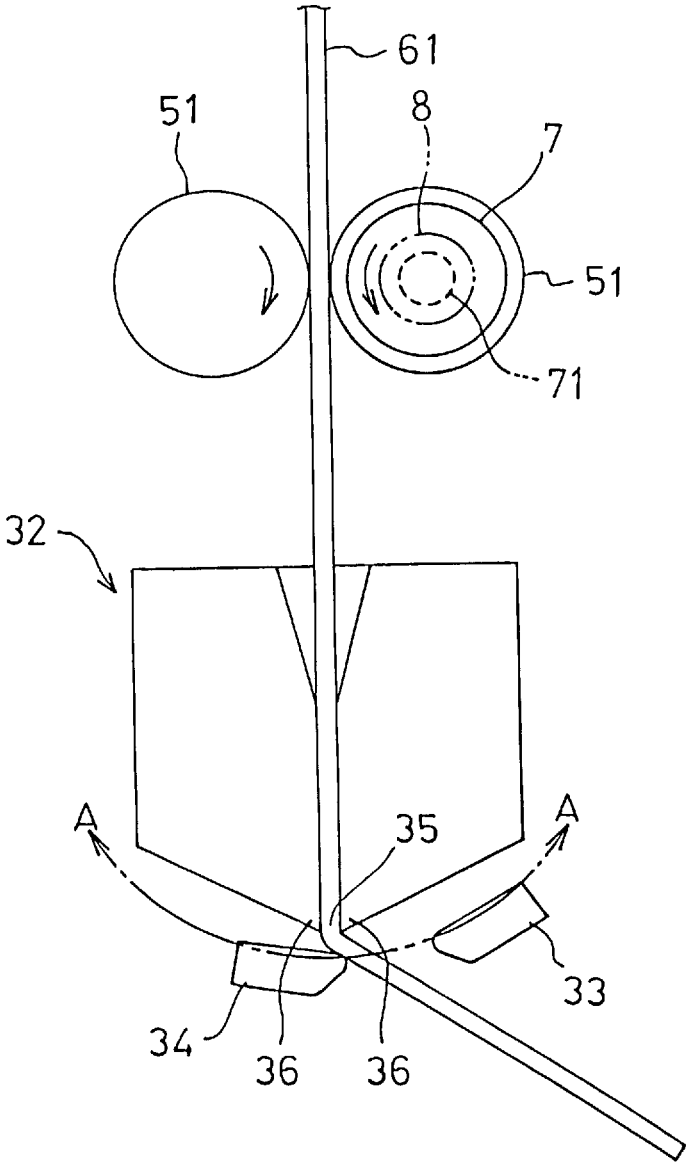
FIG. 25 is a diagram showing a state where the strip material is pressed by the presser against a shaping face of a right outlet of a slit of the stationary die.
Figure 26:
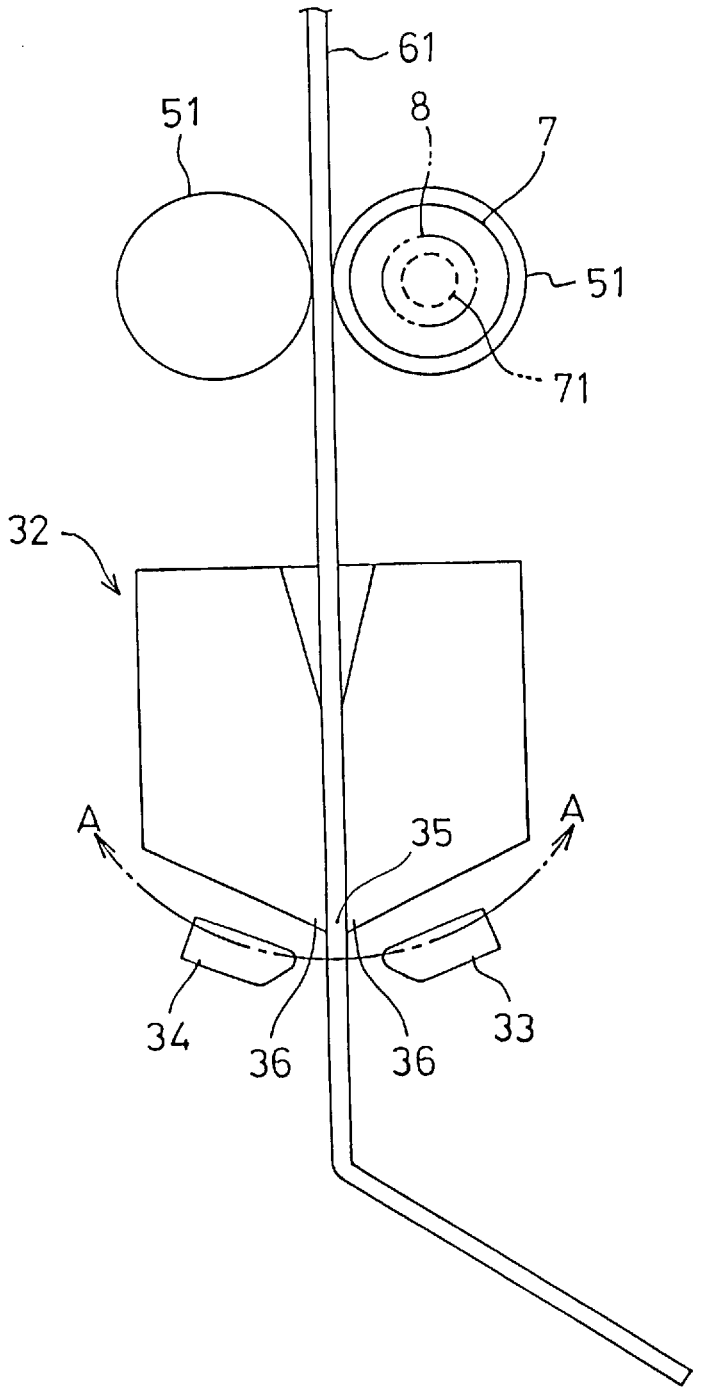
FIG. 26 is a diagram showing a state where the bend start point of a bent portion of the strip material in a next bending process corresponds to the shaping face of the outlet of the slit.
Figure 27:
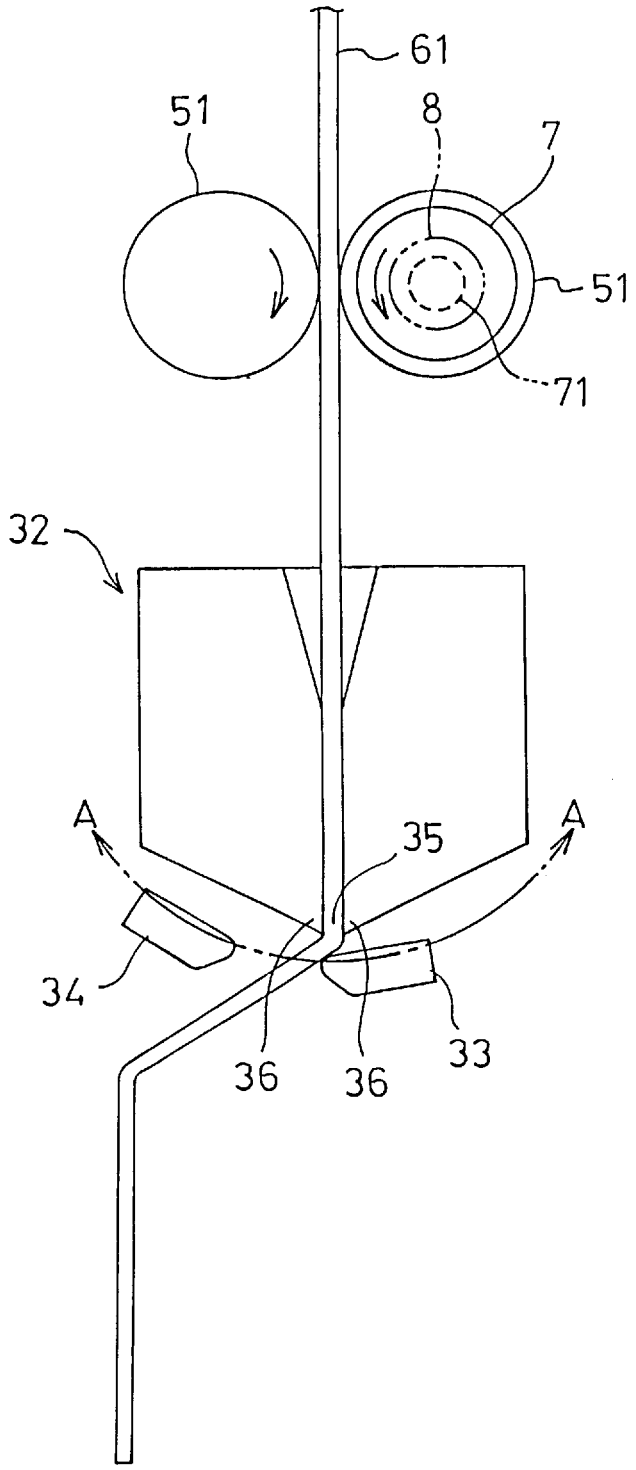
FIG. 27 is a diagram showing a state where the strip material is pressed by the presser against a shaping face of a left outlet of the slit of the stationary die.
Figure 28:
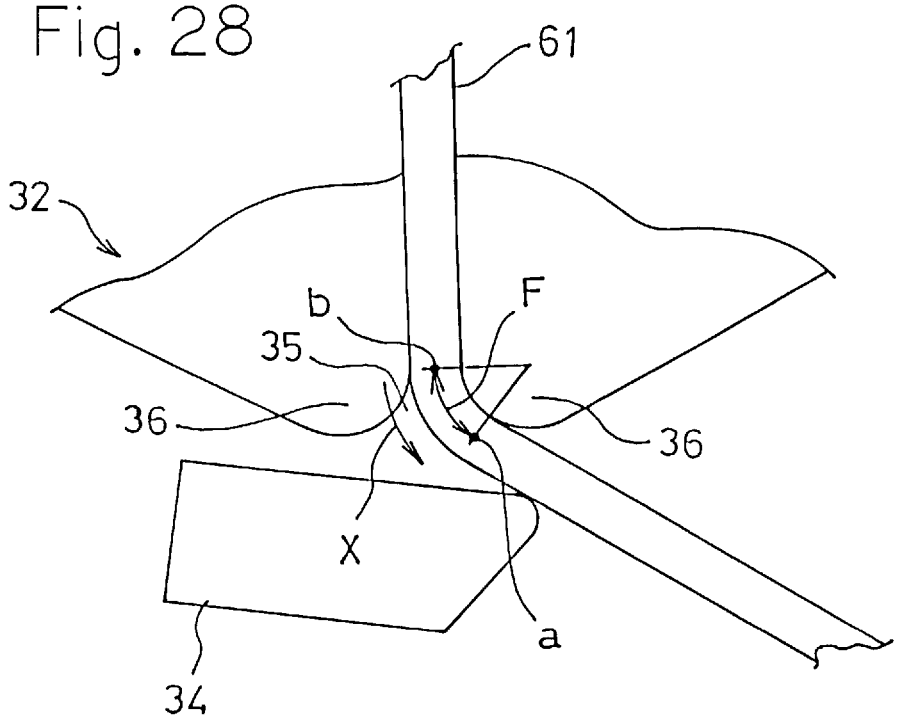
FIG. 28 is a diagram showing a state where the strip material is pulled out from the outlet of the slit of the stationary die as the strip material is bent.
Figure 29:
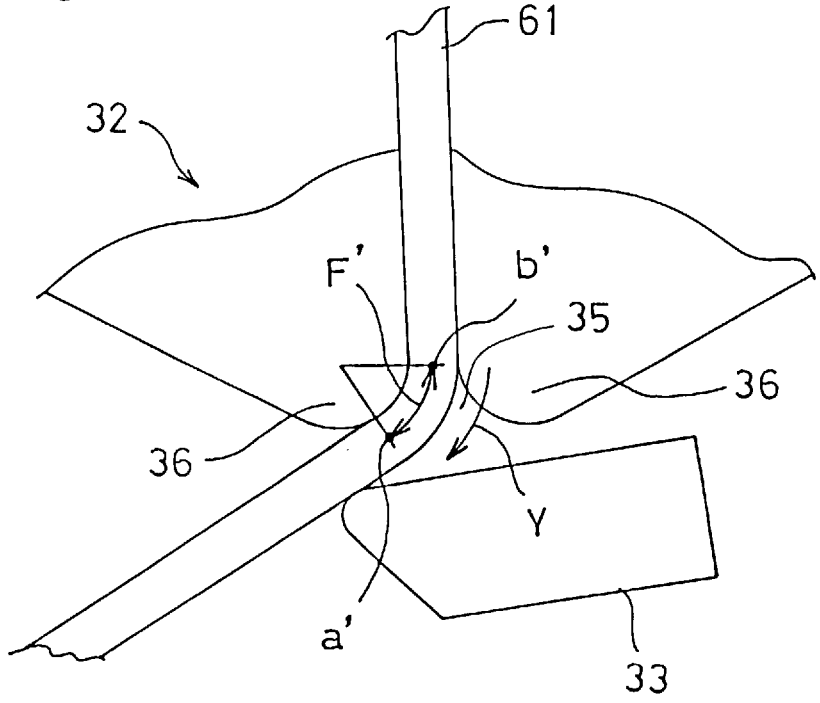
FIG. 29 is a diagram showing a state where the strip material is pulled out from the outlet of the slit as the strip material is bent.

In a period when the operation of the servomotor 7 is suspended, i.e., when the driving feed roller 51 is enabled to idle, the presser 34 is rotated by a predetermined amount together with the presser 33 as shown in FIG. 25. When the edged strip material 61 projected by a predetermined length from the outlet 35 of the stationary die 1 is pressed by the presser 34 against the right shaping face 36, the edged strip material 61 is rightward bent. At this time, as shown in FIG. 28, the edged strip material 61 is pulled out from the outlet 35 as indicated by the arrow X as the bending process advances. When the bend start and end points of the edged strip material 61 which has been bent as described above are respectively indicated by a and b, the length from the bend start point a to the bend end point b and along the bent shape of the edged strip material 61 is the pulled-out amount F of the edged strip material 61. The driving feed roller 51 idles by the rotation number (rotation angle) corresponding to the pulled-out amount F, together with the pressing feed roller 51 and with being accompanied by the rotation shaft 71 of the servomotor 7. The encoder 8 measures the pulled-out amount F at this time. Next, the servomotor 7 is operated by a rotation number in which the measured value of the encoder 8 is considered, whereby the feed roller 51 is rotated so that the edged strip material 61 is fed out from the outlet 35 as shown in FIG. 26. In this case, the bend start point a' (shown in FIG. 29) of the next process of bending the edged strip material 61 is made correspondent to the right shaping face 36 of the outlet 35 of the stationary die 35. At this timing, the operation of the servomotor 7 is suspended and the feed roller 51 is enabled to idle. When, for example, the presser 33 is reversely rotated by a predetermined amount together with the presser 34 as shown in FIG. 27 and the edged strip material 61 is pressed by the presser 33 against the left shaping face 36, therefore, the edged strip material 61 is leftward bent. At this time, as shown in FIG. 29, the edged strip material 61 is pulled out from the outlet 35 as indicated by the arrow Y as the bending process advances. When the bend end point of the edged strip material 61 which has been bent as described above is indicated by b', the length from a bend start point a' to the bend end point b' and along the bent shape of the edged strip material 61 is the pulled-out amount F' of the edged strip material 61. The driving feed roller 51 idles by the rotation number (rotation angle) corresponding to the pulled-out amount F', with being accompanied by the rotation shaft 71 of the servomotor 7. The encoder 8 measures the pulling out amount F' at this time. Next, the servomotor 7 is operated by a rotation number in which the measured value of the encoder 8 is considered, whereby the feed roller 51 is rotated so that the edged strip material 61 is fed out by a predetermined length from the outlet 35.

When the bending method described above is conducted, it is possible to accurately bend plural portions which are to be bent and are previously set in the edged strip material 61.

The embodiment described above is configured so that the feed roller 51 is rotated by the servomotor 7 and, in the bending process, the rotation shaft 71 of the servomotor 7 idles together with the feed roller 51. This configuration is employed because of the following reason. In the bending process, a very large pulling force is exerted on the edged strip material 61. If the rotation shaft 71 of the servomotor 7 cannot idle at such a time, therefore, there arises a fear that the edged strip material 61 slips with respect to the feed roller 51 and the encoder 8 cannot accurately measure the pulled-out amount F or F'.

Figure 31:
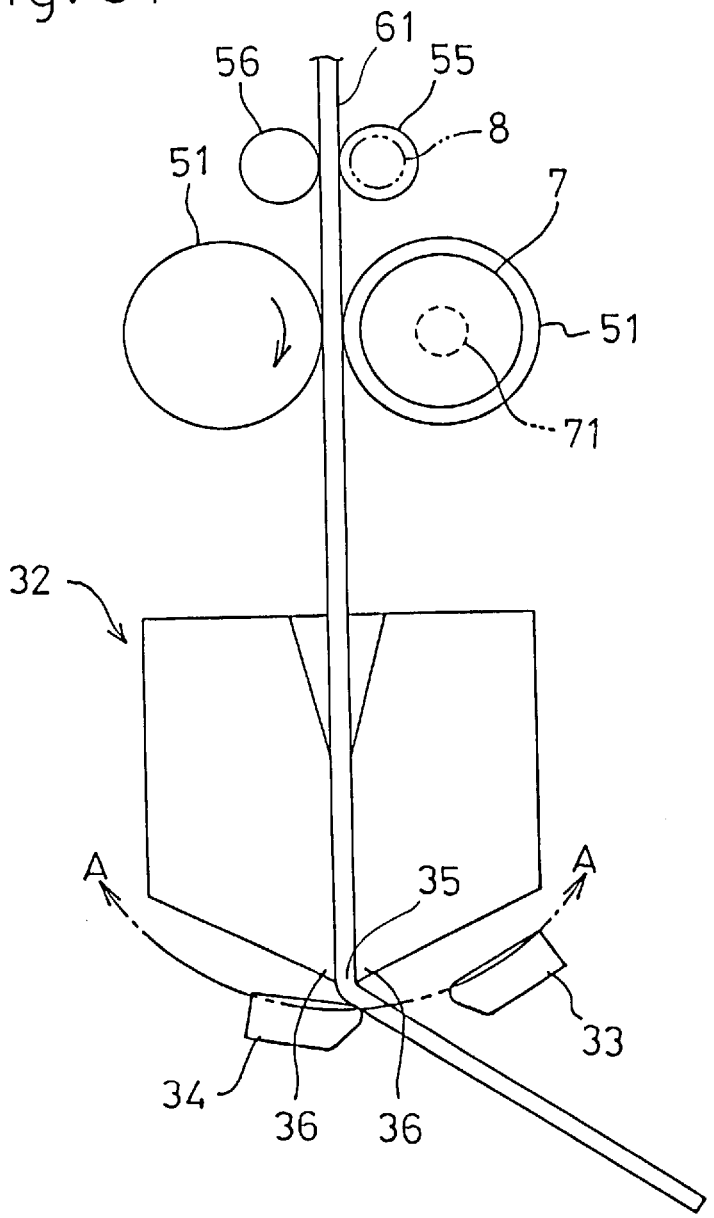
FIG. 31 is a diagram showing a state where the strip material is pressed by the presser against the shaping face of the right outlet of the slit of the stationary die.

FIG. 31 illustratively shows features in configuration of a bending apparatus according to an embodiment of the other invention. In the figure, 55 designates a measuring roller. A pressing roller 56 is disposed in the vicinity of the measuring roller 55. An encoder 8 is attached to the measuring roller 55. No encoder is attached to a feed roller 51 which is rotated by a servomotor 7. The other configuration of the bending apparatus is the same as that illustrated with reference to FIGS. 24 and 27.

A bending method in which the bending apparatus of FIG. 31 is used will be described.

Figure 32:
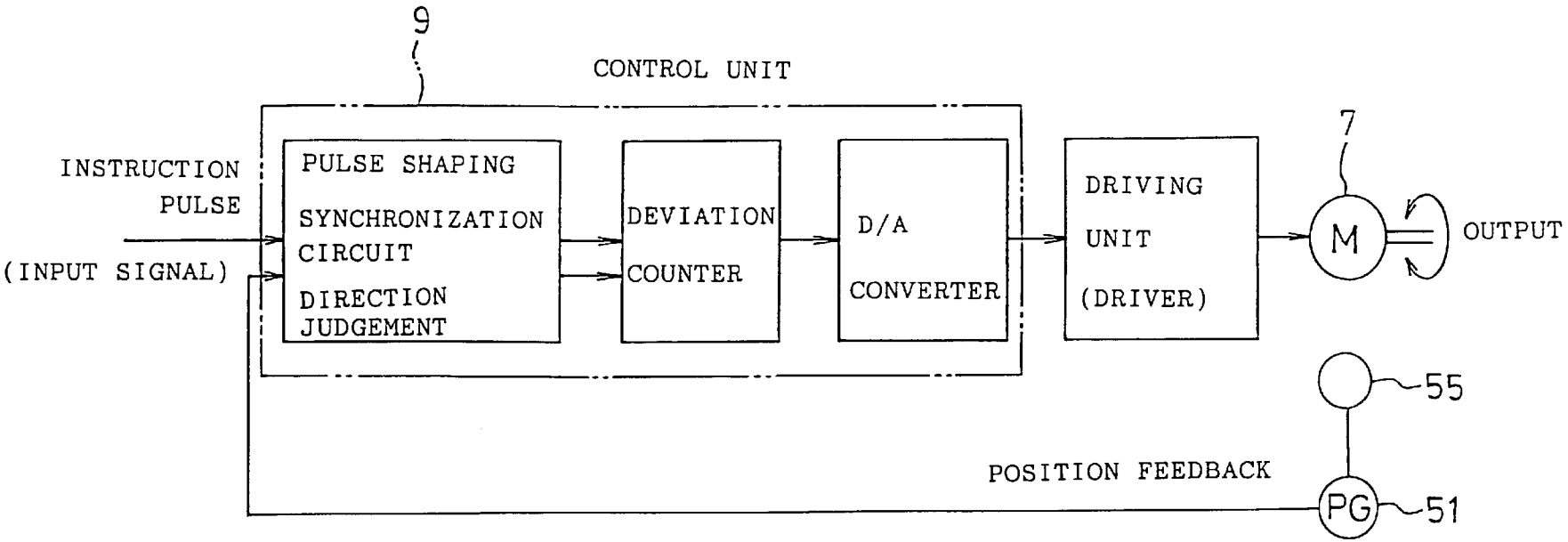
FIG. 32 is a block diagram showing a control unit, etc.

As seen from FIG. 31, in the bending method, a pulled-out amount of the edged strip material 61 from the bend start point to the bend end point in the bending process is measured by the encoder 8 via the rotation of the measuring roller 55 which is rotated with following the movement of the edged strip material 61. The feed roller 51 is rotated by a rotation number in which the measured value of the encoder 8 is considered, thereby feeding out the strip material to a position where the bend start point of the edged strip material 61 in the next bending process corresponds to the shaping faces 36 and 36 of the outlet 35 of the stationary die 32. This method is different in this point from the bending method of FIGS. 24 to 27, and the same in the other points with the bending method. FIG. 32 shows in a form of a block diagram a control unit 7, etc. which are used in this bending method.

In the bending method, when the bending process is conducted while the rotation of the feed roller 51 is stopped, the rotation shaft 71 of the servomotor 7 is not always required to be enabled to idle. Specifically, even when the edged strip material 61 pulled out in the bending process slips with respect to the feed roller 51, the measuring roller 55 accurately follows the movement of the edged strip material 61 at this time. Therefore, the pulled-out amount of the strip material is measured accurately by the encoder 8.

When either of the bending apparatuses of the embodiments of FIGS. 24 to 32 is replaced with the bending apparatus of FIGS. 1 to 4, the bending and notching processes can be conducted more accurately.

According to the method of producing a band blade of the invention, since the process object region of an edged strip material which has been subjected to notching and bending processes is finally cut off from the not-yet-processed region, there is an advantage that, during the processing of the process object region, the not-yet-processed region can be used as a portion which is to be clamped or held by a hand. The portion can be used as the process object region in the next process, and hence it is unnecessary to conduct a cumbersome end process and the material loss due to a scrap material is reduced.

According to the method of producing a band blade of the invention, the notching process and the bending process can be continuously conducted in this sequence by using the bending apparatus and the notching apparatus which are arranged in the direction of feeding an edged strip material. When the invention is employed, therefore, it is possible to provide an automatic band blade producing apparatus in which a notching apparatus and a bending apparatus are integrated with each other. Furthermore, band blades of a predetermined shape can be continuously produced in succession from a long edged strip material without producing the material loss due to an end process.

In the method of producing a band blade of the invention, the notching process can be conducted in succession with intermittently moving the process object region of an edged strip material in the longitudinal direction with respect to the notching apparatus at a fixed position. Therefore, the process of forming a notch in plural arbitrary portions of the process object region can be easily automatically controlled by a computer.

According to the method of producing a band blade of the invention, a process object region of an edged strip material made of steel which is usually hardly bent by a large angle by one performance of a single bending work can be bent easily accurately into a curved shape having any raidus of curvature. The bending process can be conducted with being automatically controlled by a computer. Consequently, there is an advantage that even a bending process of a complex shape can be conducted.

According to the method of producing a band blade of the invention, miniaturization of an automatic band blade producing apparatus in which a notching apparatus and a bending apparatus are integrated with each other can be expedited.

According to the method of producing a band blade of the invention, it is possible to provide a full automatic apparatus in which steps of producing a band blade which do not produce a scrap material causing material loss can be completely automatized in accordance with a computer program. Furthermore, miniaturization of such a full automatic apparatus can be expedited.

According to the method of producing a band blade and the bending apparatus of the invention, the pulled-out amount of the strip material in the bending process is measured accurately actually by the encoder, and the measured value is considered in the feeding amount of the strip material which is to be used in the next bending process. Therefore, plural bending portions which are previously set in a strip material such as a blade member can be bent accurately. Furthermore, the necessity of controlling the motor for rotating the feed roller so as to idle in the bending process can be eliminated. According to this configuration, there is an effect that the control can be performed in an easy manner corresponding to the elimination. When the bending apparatus and the notching apparatus which are described above are combinedly used, there arises an advantage that the bending and notching processes can be conducted more accurately.

I claim:

1. A method of producing a band blade with a bending apparatus having a front consisting of an edged strip material in which notches recessed in a width direction are formed in predetermined portions in a longitudinal direction and predetermined portions are bent, comprising the steps of:

bending a process object region of said edged strip material having the notches into a predetermined shape; and under a state where said bent strip material is not returned to a bending apparatus and said bent strip material is positioned in front of said bending apparatus, cutting off a not-yet-processed region which backward elongates from said bent strip material.

2. A method of producing a band blade with a bending apparatus comprising a stationary die and a presser which presses a predetermined portion of an edged strip material fed out from an outlet of said stationary die against a shaping face formed on said outlet, thereby bending the strip material by a predetermined angle, and a notching apparatus having a function of notching an appropriate portion of the edged strip material are used, comprising the steps of:

feeding a process object region including a front end portion of a long straight edged strip material which is passed through said outlet of said stationary die of said bending apparatus to said notching apparatus;

performing a notching process in which notches recessed in the width direction are formed in the process object region;

pulling a predetermined length of the process object region of the edged strip material which has been subjected to the notching process into the bending apparatus through said outlet of said stationary die of said bending apparatus, a predetermined portion of the process object region of the edged strip material is opposed to said shaping face of said outlet of said stationary die;

pressing the predetermined portion of the process object region against said shaping face of said outlet by said presser, thereby performing a bending process in which the process object region is bent into a desired shape; and cutting off the process object region which has been subjected to the notching process and the bending process from a not-yet-processed region which elongates from the process object region.

3. A method of producing a band blade according to claim 2, further comprising the steps of:

intermittently moving the process object region fed to said notching apparatus in a longitudinal direction; and forming a notch at a fixed position in the process object region in a period when the movement is stopped, thereby forming a notch in plural portions of the process object region in the longitudinal direction.

4. A method of producing a band blade according to claim 2, further comprising the steps of:

intermittently feeding out the process object region from said outlet of said stationary die after a predetermined length of the process object region of the edged strip material which has been subjected to the notching process is pulled through said outlet of said stationary die so that different portions of the process object region are opposed to said shaping face of said outlet; and repeating the movement of said presser by a predetermined width, in a period when the feeding of the process object region is stopped, thereby pressing the portion of the process object region opposing said shaping face against said shaping face so as to be bent by a predetermined angle, whereby the portion can be bent as a whole into a curved shape.

5. A method of producing a band blade according to claim 3, further comprising the steps of:

intermittently feeding out the process object region from said outlet of said stationary die after a predetermined length of the process object region of the edged strip material which has been subjected to the notching process is pulled through said outlet of said stationary die; so that different portions of the process object region are opposed to said shaping face of said outlet; and repeating the movement of said presser by a predetermined width, in a period when the feeding of the process object region is stopped, thereby pressing the portion of the process object region opposing said shaping face against said shaping face so as to be bent by a predetermined angle, whereby the portion can be bent as a whole into a curved shape.

6. A method of producing a band blade according to claim 2, further comprising the steps of:

lowering said notching apparatus so that the bent portion does not collide with said notching apparatus:

feeding a boundary portion between the process object region and the not-yet-processed region to said notching apparatus, after the process object region is subjected to the notching process and the bending process, by feeding out the edged strip material through said outlet of said stationary die of said bending apparatus;

elevating said notching apparatus; and cutting off the boundary portion by said notching apparatus.

7. A method of producing a band blade according to claim 2, further comprising the step of:

drawing out the long straight edged strip material from a roll in which a hoop material is wound in a coil-like shape.

8. A method of producing a band blade according to claim 2, further comprising the steps of:

supporting a portion of the edged strip material which has not yet reached said outlet of said stationary die of said bending apparatus by a feed roller; and controlling the feeding of the edged strip material and the movement in the longitudinal direction by rotation of said feed roller.

9. A method of producing a band blade according to claim 2, further comprising the steps of:

measuring by an encoder a pulled-out amount from a bend start point to a bend end point of the strip material when the strip material is pulled out from said outlet as the strip material is pressed against said shaping face of said outlet of said stationary die and bent said encoder being attached to a rotation shaft of a servomotor which idles together with a feed roller which has made contact with the strip material; and rotating said feed rollers by operating said servomotor by a rotation number in which a measured value of said encoder is considered, thereby feeding out the strip material from said outlet of said slit to a position where the bend start point of the strip material in a next bending process corresponds to said shaping face of said outlet of said stationary die.

10. A method of producing a band blade according to claim 2, further comprising the steps of:

rotating a measuring roller which makes contact with the strip material, the measuring roller being rotated following the movement of the strip material produced when the strip material is pulled out from said outlet as the strip material is pressed against said shaping face of said outlet of said stationary die and bent;

measuring by an encoder a pulled-out amount of the strip material from a bend start point to a bend end point of the strip material when the strip material is pulled out from said outlet of said slit said encoder being attached to said measuring roller; and rotating said feed roller by a rotation number in which a measured value of said encoder is considered, thereby feeding out the strip material from said outlet of said slit to a position where the bend start point of the strip material in a next bending process corresponds to said shaping face of said outlet of said stationary die.

11. A method of bending a strip material, comprising the steps of:

contacting the strip material with a feed roller which is connected to a rotation shaft of a servomotor in a state where idle rotation is inhibited;

intermittently rotating said feed roller by said servomotor and causing said feed roller to idle when the operation of said servomotor is suspended;

repeatedly conducting a process while the strip material is intermittently fed out through a slit formed in a stationary die by the intermittent rotation of said feed rollers, in which the strip material is pressed against a shaping face of an outlet of said slit by a presser every time the feeding of the strip material is stopped by the suspension of the operation of said servomotor, thereby bending the strip material;

measuring by an encoder attached to a rotation shaft of said servomotor which idles together with said feed roller when in contact with the strip material a pulled-out amount from a bend start point to a bend end point of the strip material when the strip material is pulled out from said outlet as the strip material is pressed against said shaping face of said outlet of said stationary die and bent; and rotating said feed roller by operating said servomotor by a rotation number in which a measured value of said encoder is considered, thereby feeding out the strip material from said outlet of said slit to a position where the bend start point of the strip material in a next bending process corresponds to said shaping face of said outlet.

12. An apparatus for bending a strip material, comprising:

a stationary die having a slit through which the strip material is to be passed, said slit having an outlet and a shaping face at said outlet;

a presser which is reciprocally movable along a path crossing a vicinity of said outlet of said slit and which presses the strip material passed through said slit, against said shaping face of said outlet of said slit, thereby bending the strip material; a servomotor having a rotation shaft; a feed roller which is connected to said rotation shaft of said servomotor in a state where idle rotation is inhibited and which is able to idle in a period when operation of said servomotor is suspended, and which has made contact with the strip material, thereby giving a feeding force to the strip material;

an encoder which is attached to said rotation shaft of said servomotor and which measures a rotation amount of said feed roller; and a control unit which controls a rotation number of said rotation shaft of said servomotor on the basis of a pulse signal generated by said encoder.

* * * * *